US007731638B2

(12) United States Patent
Webber et al.

(10) Patent No.: US 7,731,638 B2
(45) **Date of Patent: *Jun. 8, 2010**

(54) EXERCISE MACHINE WITH MOVING USER SUPPORT AND MULTIPLE PART LINKAGE

(75) Inventors: Randall T. Webber, La Jolla, CA (US); Christopher E. Brennan, Murrieta, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/135,679

(22) Filed: Jun. 9, 2008

(65) Prior Publication Data

US 2008/0242517 A1 Oct. 2, 2008

Related U.S. Application Data

(62) Division of application No. 10/633,805, filed on Aug. 4, 2003, now Pat. No. 7,594,880.

(51) Int. Cl.
*A63B 21/00* (2006.01)

(52) U.S. Cl. ..... 482/72; 482/96; 482/95

(58) Field of Classification Search ..... 482/95, 482/96, 140, 72, 137, 142
See application file for complete search history.

(56) References Cited

U.S. PATENT DOCUMENTS 2,145,940 A 2/1939 Marlowe
4,441,708 A 4/1984 Brentham
4,478,411 A 10/1984 Baldwin
4,511,137 A 4/1985 Jones
4,641,833 A 2/1987 Trethewey (Continued)

FOREIGN PATENT DOCUMENTS

CA 2075331 2/1994

OTHER PUBLICATIONS

U.S. Appl. No. 12/212,090 of Webber et al. filed Sep. 17, 2008.

(Continued)

*Primary Examiner*—Jerome Donnelly
(74) *Attorney, Agent, or Firm*—Procopio, Cory, Hargreaves & Savitch LLP

(57) ABSTRACT

An exercise machine has a main frame and a user support frame pivotally mounted relative to the main frame for rotation about a user support pivot axis between start and end positions. The user support frame has at least a primary support and a secondary support for supporting spaced positions on a user's body throughout an exercise movement. The user support pivot axis is spaced below at least one of the supports in at least one of the exercise start and end positions. A user engagement device is movably mounted relative to the frames for engagement by the user in performing exercises, and a multiple part connecting linkage translates movement of the user engagement device to rotational movement of the user support frame. A load resists movement of at least one of the user support, user engagement device, and connecting linkage.

54 Claims, 11 Drawing Sheets

U.S. PATENT DOCUMENTS 4,743,010 A 5/1988 Geraci
4,822,038 A 4/1989 Maag
4,844,456 A 7/1989 Habing et al.
4,944,641 A 7/1990 Alves
4,949,958 A 8/1990 Richey
5,236,406 A 8/1993 Webber
5,254,067 A 10/1993 Habing et al.
5,330,404 A 7/1994 Lopeteguy et al.
5,330,405 A 7/1994 Habing et al.
5,342,270 A 8/1994 Jones
5,352,171 A * 10/1994 Lin ..... 482/96
5,354,248 A 10/1994 Rawls et al.
5,356,358 A * 10/1994 Chen ..... 482/96
D357,041 S 4/1995 McBride et al.
5,417,634 A 5/1995 Habing
5,478,298 A 12/1995 Chen
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang et al.
5,573,482 A * 11/1996 Wang et al. ..... 482/96
5,580,340 A 12/1996 Yu
5,582,563 A 12/1996 Fan
5,616,105 A 4/1997 Wang
5,620,402 A 4/1997 Simonson
5,626,542 A 5/1997 Dalebout et al.
5,643,147 A * 7/1997 Huang ..... 482/72
5,669,865 A 9/1997 Gordon
5,674,161 A 10/1997 Lin
5,683,334 A 11/1997 Webber
5,720,695 A 2/1998 Eckmann
5,722,918 A 3/1998 Lee
5,810,698 A 9/1998 Hullett et al.
5,899,836 A 5/1999 Chen
5,938,570 A 8/1999 Maresh
5,944,641 A 8/1999 Habing
5,961,427 A * 10/1999 Habing et al. ..... 482/96
6,004,247 A 12/1999 Webber
6,090,020 A 7/2000 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,605,024 B2 8/2003 Stearns
6,752,748 B1 6/2004 Scotti
6,811,522 B1 11/2004 McQuinn
6,855,098 B2 2/2005 Reitz et al.
6,916,278 B2 7/2005 Webber
6,971,978 B2 12/2005 Hyder
7,052,444 B2 5/2006 Webber
7,052,446 B2 5/2006 Morris et al.
7,070,545 B2 7/2006 Lull et al.
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 * 2/2008 Webber et al. ..... 482/137
7,335,140 B2 * 2/2008 Webber et al. ..... 482/98
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0187879 A1 12/2002 Ball et al.
2003/0199362 A1 10/2003 Chamberlin
2005/0032611 A1 2/2005 Webber et al.
2006/0247107 A1 11/2006 Carter
2006/0276313 A1 12/2006 Hong
2007/0232462 A1 10/2007 Webber et al.
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0234110 A1 9/2008 Webber et al.
2008/0248929 A1 10/2008 Webber et al.

OTHER PUBLICATIONS

V-Bench Leg Curl, Maxicam and Leg Extension, Mexicam, Muscle Dynamics Brochure, date unknown.
CL2501 Seated Shoulder Press and Cl2301 Chest Press, Hoist Fitness Systems Brochure undated.
Hoist Fitness Systems CL2301 Chest Press, Manufacturing Drawing, Mar. 2001.
Hoist Fitness Systems CL2501 Seated Shoulder Press, Jul. 2000.

* cited by examiner

EXERCISE MACHINE WITH MOVING USER SUPPORT AND MULTIPLE PART LINKAGE

RELATED APPLICATIONS

The present application is a Divisional of co-pending U.S. patent application Ser. No. 10/633,805 filed on Aug. 4, 2003, the contents of which are incorporated herein by reference in their entirety.

BACKGROUND

1. Field of the Invention

This invention relates generally to exercise machines, and is particularly concerned with an exercise machine with a moving user support which has a multiple part linkage system.

2. Related Art

Movable user supports linked to the movement of an exercise arm are extremely common in exercise machines, and are generally known as composite motion exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causes the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

Current exercise machines with pivoting or movable user supports often do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, potentially causing strain or injury.

SUMMARY

Embodiments described herein provide for an exercise machine with a pivoting user support which has a multiple part linkage which translates movement of an exercise arm or engagement device into movement of the user support.

An exercise machine in one embodiment comprises a stationary main frame, a user support frame pivotally associated with the main frame, a user engagement device movably mounted relative to the frames for actuating by a user in order to perform an exercise, and a connecting linkage which links movement of the user engagement device to movement of the user support. The user support frame has primary and secondary support portions which support spaced parts of a user's body when positioned on the user support frame and which are fixed relative to one another throughout an exercise movement. The user support pivot axis is located below at least one of the support portions through at least part of an exercise movement. A load provides resistance to movement of the user support frame, user engagement device and/or connecting linkage. The connecting linkage and pivot mount are arranged so that movement of the exercise arm results in self-aligning movement of the user support. The connecting linkage is a multiple part linkage having two or more rigid links which are connected together pivotally or telescopically, two or more flexible links, or a combination of rigid and flexible links.

In one embodiment, the connecting linkage comprises two telescopically connected rigid parts or members. In another embodiment, the connecting linkage includes one or more pivoted connecting links. Another alternative multiple part connecting linkage includes a slide member mounted on a rail on one of the frames and a roller or other traveling member associated with the slide member which runs on a track in the other frame. Other connecting linkages include a cable and pulley linkage system and a multiple cam system including flexible lines extending from the cams to at least two of the main frame, user support, and user engagement device.

The exercise machine may be designed to perform any type of exercise such as leg exercises, upper body exercises, and the like. The user engagement device may comprise one or more movably mounted exercise arms, or may be handles connected to one or more flexible members. In one embodiment, two exercise arms or handles may be movable in unison or independently.

In one embodiment, the primary support portion is a seat pad which is at a first orientation in the exercise start position and rotates forwards or rearwards into a second orientation at the end of the exercise. The seat pad may be horizontal, inclined or reclined in an exercise start position. In one embodiment, the seat pad rotates from an inclined or reclined start position through the horizontal orientation into a reclined or inclined end position. The secondary support portion may comprise an upright support pad for the user's back or chest, an upright member with hold down pads for extending over the user's thighs, or a foot rest, and more than one secondary support portion may be provided to support different parts of a user's body. Because the user support frame moves in conjunction with the exercise arm or user engagement device, the arcuate path of the exercise arm relative to the user support frame is reduced. The result is a more natural feeling exercise movement that more closely replicates the movement found in the corresponding free weight exercise.

In one embodiment, the user support pivot axis defines a vertical gravitational center line, and a portion of the combined weight of the user and user support frame is positioned one each side of the gravitational center line at least in the start or end position. In one embodiment a portion of the combined weight is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line, resulting in either a high initial lifting resistance, or else a resistance "drop off" at the end of the exercise.

The user engagement device may be movably associated with the user support frame, the main frame, or with a part of the connecting linkage. The user engagement device may be a bi-directional exercise arm. The multiple part connecting linkage translates movement of the user engagement device to rotational movement of the user support frame.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 2:
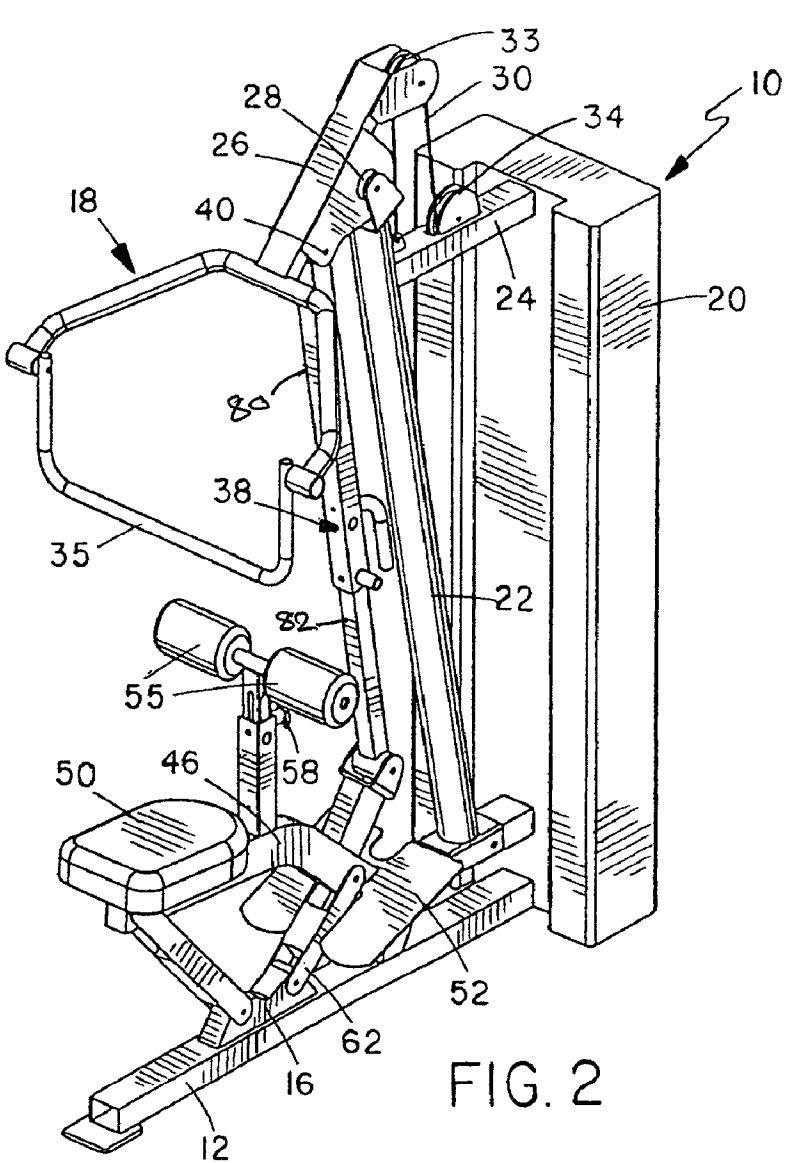
FIG. 2 is a perspective view similar to FIG. 1, illustrating the machine in an exercise ending position.

Certain embodiments as disclosed herein provide for an exercise machine having an exercise arm or user engagement device and user support which travel in a dependent relationship. The exercise machines in the embodiments disclosed herein have a multiple part connecting linkage which translates movement of a user engagement device to movement of the user support, and is designed to provide a pivoting user support which automatically aligns with movement of the exercise arm or user engagement device and which provides appropriate positioning of the user throughout the entire exercise movement.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 4 illustrate a rigid arm pull down machine 10 which allows a user to perform chin up type exercises similar to the free body weight exercise performed by a user pulling themselves up from the ground while gripping an overhead bar or "chinning" bar, with the user raising their body until their chin touches the bar. The exercise carried out with the machine 10 accurately mimics the natural body alignment in the start and finish positions of a free body weight chin up exercise, as explained in more detail below.

The machine 10 comprises a main frame having a horizontal base section 12 and an upright section 14, a generally T-shaped user support frame 15 pivotally mounted on the base section via pivot mount 16, and an exercise arm 18 pivotally mounted at the top of the upright section 14 of the frame. The upright section 14 of the frame includes a vertical housing 20 containing a weight stack (not visible in the drawings), and a slightly forwardly inclined upright strut 22. A horizontal strut 24 extends between the top of housing 20 and the upright strut 22.

The exercise arm 18 comprises a generally U-shaped member 25 with a forwardly projecting arm portion 26 extending from the mid-point of the U-shaped member and pivoted to the upper end of strut 22 via pivot 28 at a mid point in its length. The forward end of arm portion 26 is linked to the weight stack (not visible in the drawings) via a cable 30 extending from anchor 32 on the horizontal strut 24, over a pulley 33 at the end of arm portion 26, then back around pulley 34 on strut 24 and via additional pulleys (not visible in the drawings) to the top of the weight stack. A U-shaped handle bar 35 is pivoted at pivot 36 to the ends of the U-shaped member 25 so as to be suspended downwardly from bar 25 for gripping by a user.

An adjustable length, multiple part connecting linkage 38 pivotally connects the exercise arm 18 to the user support frame 15. The link 38 has a first end pivoted to portion 26 of the exercise arm at pivot 40, and a second end pivoted to the user support frame 15 at pivot 42. The link 38 comprises two telescopically engaging parts 80, 82 which are secured together at a selected extension via a spring loaded pull pin 44 engaging in a selected opening 45 in one of the telescoping parts.

The generally T-shaped user support frame 15 has a base member 46 and an upright member 48 projecting upwardly from the central region of member 46. A seat pad or primary support 50 is mounted at the rearward end of base member 46, facing upright member 48. At least one secondary or additional support is also mounted on the user support frame. In this embodiment, one secondary or additional support comprises a pair of roller pads 5 or thigh hold down pads 55 on a strut 56 telescopically mounted in member 48. The position of the roller pads 55 can be adjusted by moving strut 56 up or down and then securing it in position via a spring loaded pull pin 58. Another secondary or additional user support comprises a foot rest 52 mounted at the end of member 46. The connecting link pivot 42 is provided on pivot bracket 54 adjacent foot rest 52.

Figure 4:
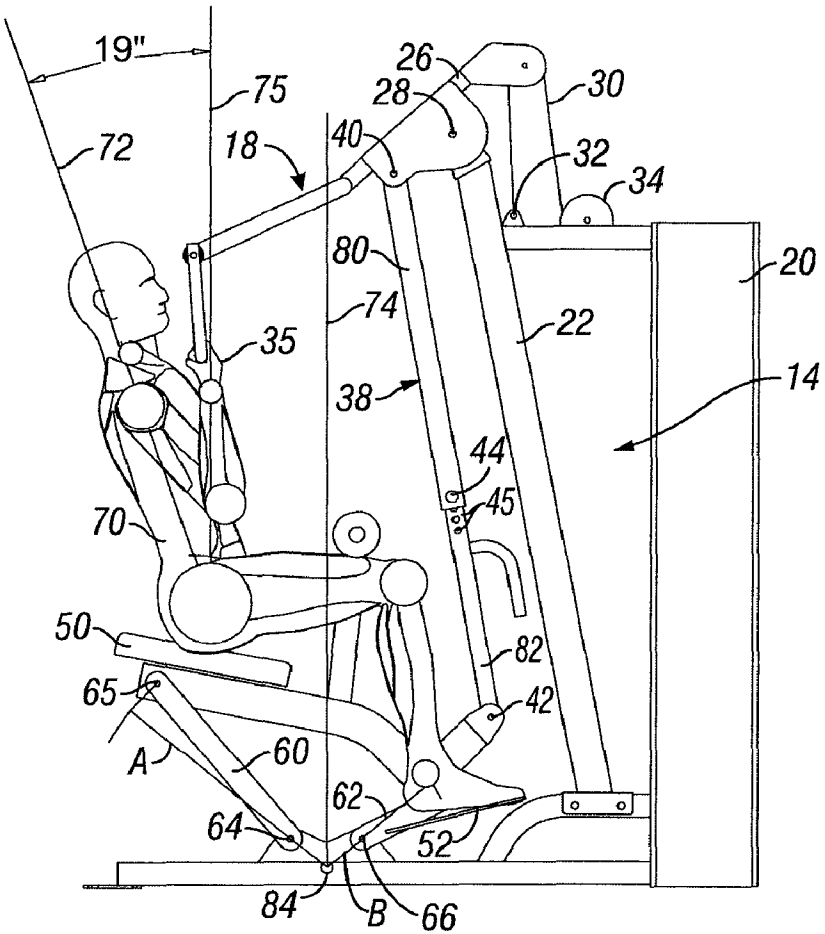
FIG. 4 is a side elevation view similar to FIG. 3, illustrating the exerciser's body position at the end of the pull down exercise.
Figure 3:
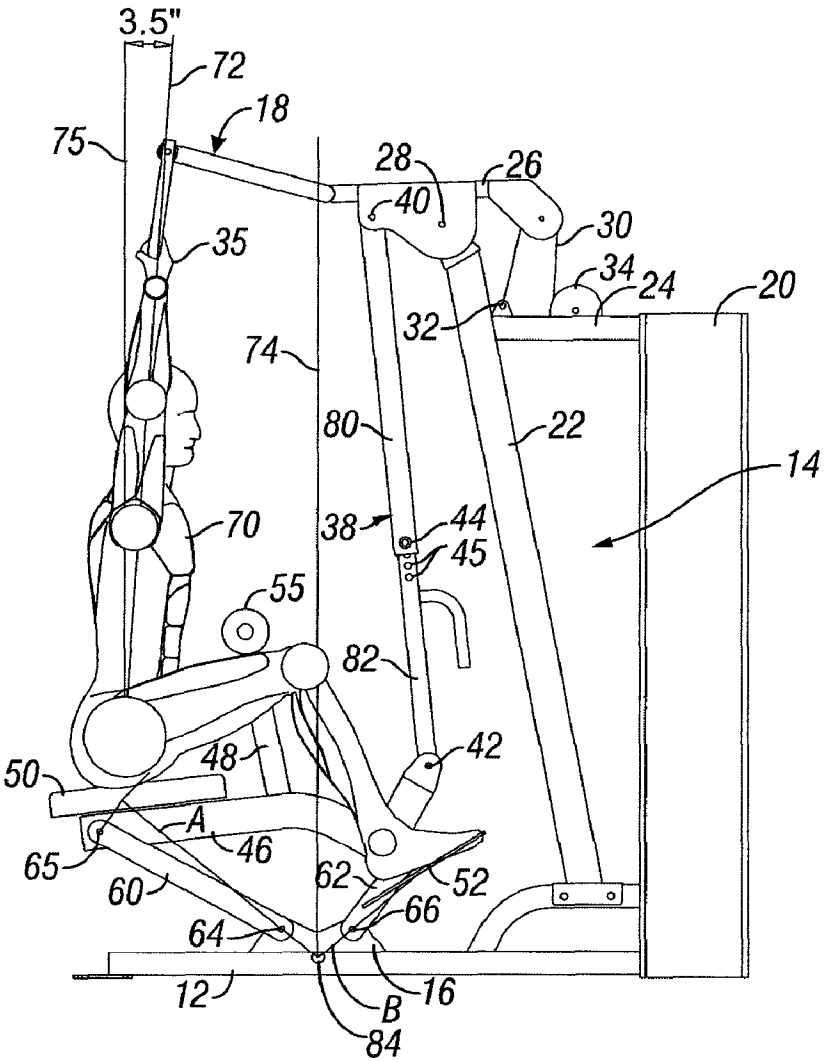
FIG. 3 is a side elevation view of the machine of FIGS. 1 and 2, illustrating an exerciser's body position at the start of the exercise.

The user support frame is pivotally mounted on base 12 via a four bar linkage system comprising the base strut 46 of the user support, the pivot mount 16, and a pair of lever arms 60, 62 each pivotally connected between the pivot mount 16 and the user support base strut 46. The first lever arm 60 is pivoted at one end to the rearward end of pivot mount 16 via pivot 64, and to the rearward end of base strut 46 at the opposite end, via pivot 65. The second lever arm 62 is pivoted at one end to the forward end of the pivot mount 16 via pivot 66, and at the opposite end to the forward end of the base strut 46 via pivot 68. The multiple part pivot system defines a theoretical pivot axis of the user support pivotal motion. As illustrated in FIGS. 3 and 4, the theoretical pivot axis 84 is located below the user support, and a theoretical gravitational center line 74 of the pivotal motion extends through pivot axis 84. The location of the theoretical pivot axis 84 can be determined from the start and end positions of the two pivot links 60 and 62, and is the point of intersection of the centerline A of the pivotal movement of the rearward link 60 and the centerline B of the pivotal movement of the forward link 62, as indicated in FIGS. 3 and 4.

Figure 1:
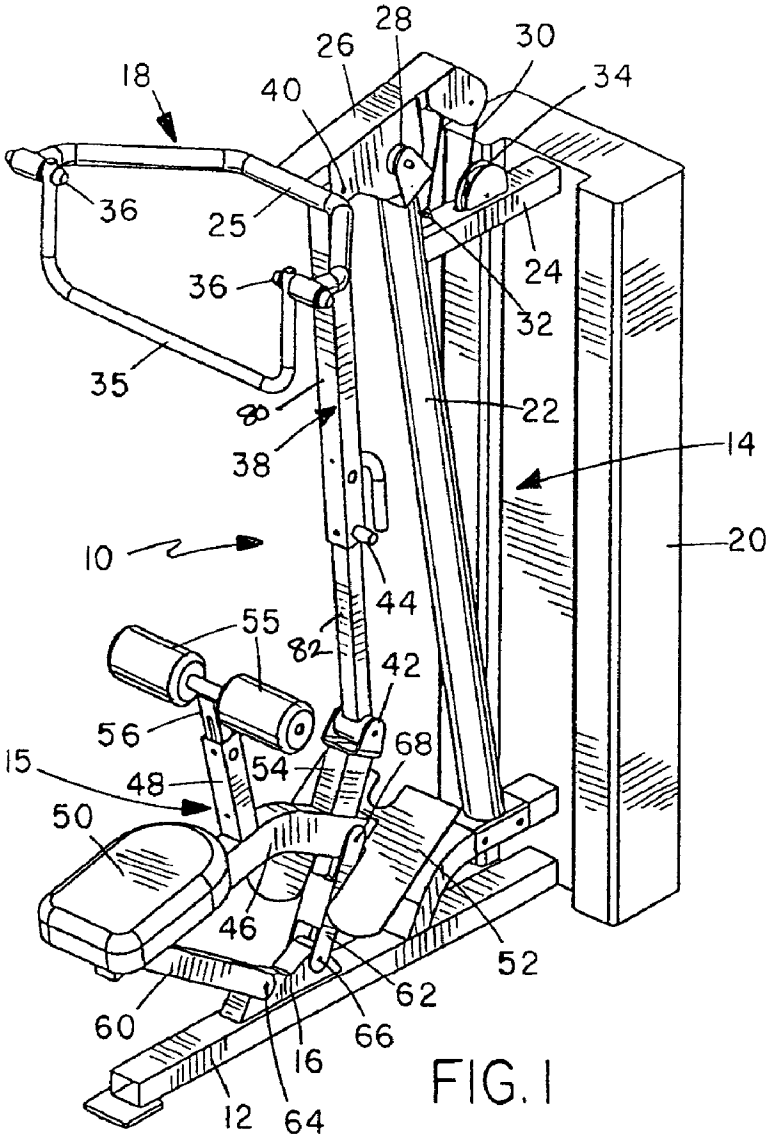
FIG. 1 is a rear perspective view of an exercise machine according to a first embodiment for performing a rigid arm pull down exercise, with the machine illustrated in a start position adopted at the beginning of an exercise movement.

FIG. 1 illustrates the start position of the rigid arm pull down machine without an exerciser, while FIG. 2 illustrates the finish position. FIGS. 3 and 4 illustrate the same positions with the user 70 in place to perform a chin up exercise. To perform the exercise, the user positions themself in a seated position on seat pad 50, which will start in a slightly downwardly reclined orientation as illustrated in FIG. 3. They then slide their legs under the thigh hold down roller pads 55, adjusting the position of these pads by sliding the strut 56 up and down if necessary, and place their feet on the user support footrest or plate 52. They then grab the handle bar 35 of the exercise arm 18 and pull it downwards. The starting position of FIG. 3 places the user's upper body in a slightly forward lean with their arms extending straight overhead, in line with the side center line 72 of their body. If necessary, the user can adjust the distance between the user support seat 50 and exercise arm bar or handle 35 by adjusting the length of connecting link 38.

As the exercise arm 18 moves downwards, rotating about the pivots 28 and 40, the connecting link 38 pushes the forward end of the user support frame 15 downwards, rotating the frame about the four bar linkage into the finish position illustrated in FIG. 4, in which the seat pad 50 is moved into an upwardly inclined orientation. At the same time, the selected weights in the weight stack are lifted via the cable and pulley linkage between the forward end of the exercise arm and the weight stack. As the seat pad changes its orientation from a reclined angle to an inclined angle, the user will automatically adjust their upper body position rearward (relative to their angular position on the seat) to compensate for this change in seat angle, and will finish the exercise with their hands below their chin and slightly in front of their shoulders. This slight rearward movement mimics the natural rearward arc a person's upper body goes through when performing a free bar chin up. The exercise machine closely mimics the natural body alignment of an exerciser in both the start and finish positions when performing body weight exercises on a chinning bar. This provides the user with a safer and more comfortable compound exercise movement than was possible with previous rigid arm pull down exercise machines.

The user support theoretical pivot axis 84 is positioned under the user support frame such that a substantial portion of the combined weight of the user and the support frame is positioned on each side of the gravitational center line 74 of the pivot axis in both the start and finish position, as illustrated in FIGS. 3 and 4. Since the pivot is a four bar linkage in the embodiment of FIGS. 1 to 4, the center line 74 is a theoretical center line of the pivotal movement. The portion of both the user and the user support positioned on each side of line 74 varies only very slightly from the start to the finish point of the exercise movement. This balanced distribution minimizes the effect that the combined weight of the user and user support has on the exercise resistance, while still allowing it to act as a counter balance to offset the weight of the exercise arm. The combined weight of the user and support will have little effect on the amount of starting resistance, because a substantially equal amount of weight is balanced rearward of the user support pivot. By the same token, because only a small portion of the user passes through the gravitational center line 74 during the exercise, there is no appreciable drop off in resistance felt by the user.

The line 75 in FIGS. 3 and 4 represents the perpendicular or vertical centerline of the user in both the start and finish positions, while line 72 is the side centerline. As illustrated in FIG. 3, at the start of the exercise, the user is in a forward lean of approximately 3.5 degrees off vertical, with their arms fully extended and in line with the body side centerline. At the end of the exercise, as illustrated in FIG. 4, the user is reclining at approximately 19 degrees to the vertical centerline 75, with their hands positioned under the chin and slightly forward of their shoulders. Thus, the upper body moves through an angle of approximately 22.5 degrees, as it will when performing a free chin up exercise with an overhead chinning bar. The pull down exercise machine 10 closely mimics the natural movement and body alignment found in a free bar chin up exercise.

Another advantage of this machine is the multiple user supports. The primary user support in this case is the seat pad 50, while an additional support is provided by the thigh hold-down pads 55. Another additional support is provided by the foot pads 52 which travel with the user support frame 15. The multiple user supports help to provide proper positioning of the user relative to the user engaging portion of the exercise arm throughout the entire exercise movement. This also makes the apparatus much more comfortable and natural for the user, making the user want to exercise. The foot pads keep the user's feet in the same relaxed and supported position throughout the entire exercise movement.

The rigid arm pull down machine 10 places the user's body in a slightly forward lean at the start of the exercise, to compensate for the reclined angle of the seat, with their arms extended straight overhead and in line with their body side centerline. The body orientation changes to a reclined angle mimicking the natural rearward arc the body goes through when performing a chin up exercise, with the user finishing the exercise with their arms under their chin.

FIGS. 5 to 8 illustrate a shoulder press exercise machine 120 which substantially duplicates a free weight overhead press exercise. The shoulder press machine 120 constrains the user to follow the proper exercise path, while fully supporting the user's body throughout the exercise for comfort and safety.

The exercise machine 120 basically comprises a main frame 122, a user support frame 124 pivotally mounted on the main frame, an exercise arm 125 pivotally mounted on the main frame and linked to the user support frame by a multiple part connecting linkage 126, and an exercise resistance such as selectorized weight stack in housing 128 linked to the connecting linkage 126. The main frame 122 comprises a horizontal base section 130, a rearwardly inclined upright section or strut 132, and a pivot mount section 134. The user support frame 124 is generally L-shaped with a base 135 on which a seat pad 136 is adjustably mounted, and an upright 137 on which a back pad 138 is mounted. A foot plate or footrest 140 is secured to the forward end of the base 135. The frame 124 is pivotally mounted on the pivot mount section 134 via a pivot 142 located close to the junction between the base and upright sections of the user support frame, so that the pivot is positioned directly under the exerciser. The seat pad 136 is mounted on a strut or post 144 which is telescopically engaged in tube 145 to allow the height of the seat pad relative to the frame to be adjusted. A stop 146 on the main frame adjacent the forward end of the user support frame acts to support the user support frame in the starting position of FIGS. 5 and 7.

Figure 5:
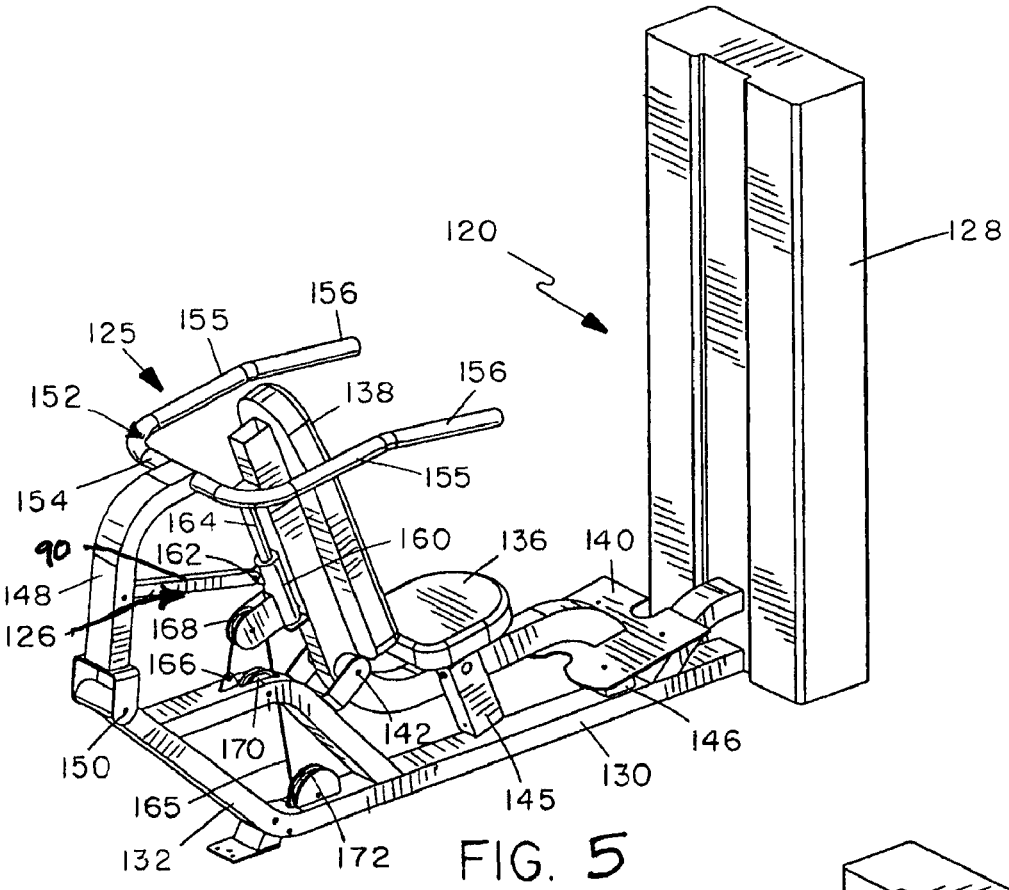
FIG. 5 is a rear perspective view of a shoulder press exercise machine according to a second embodiment for performing shoulder press exercises, with the machine illustrated in a start position adopted at the beginning of an exercise movement.
Figure 6:
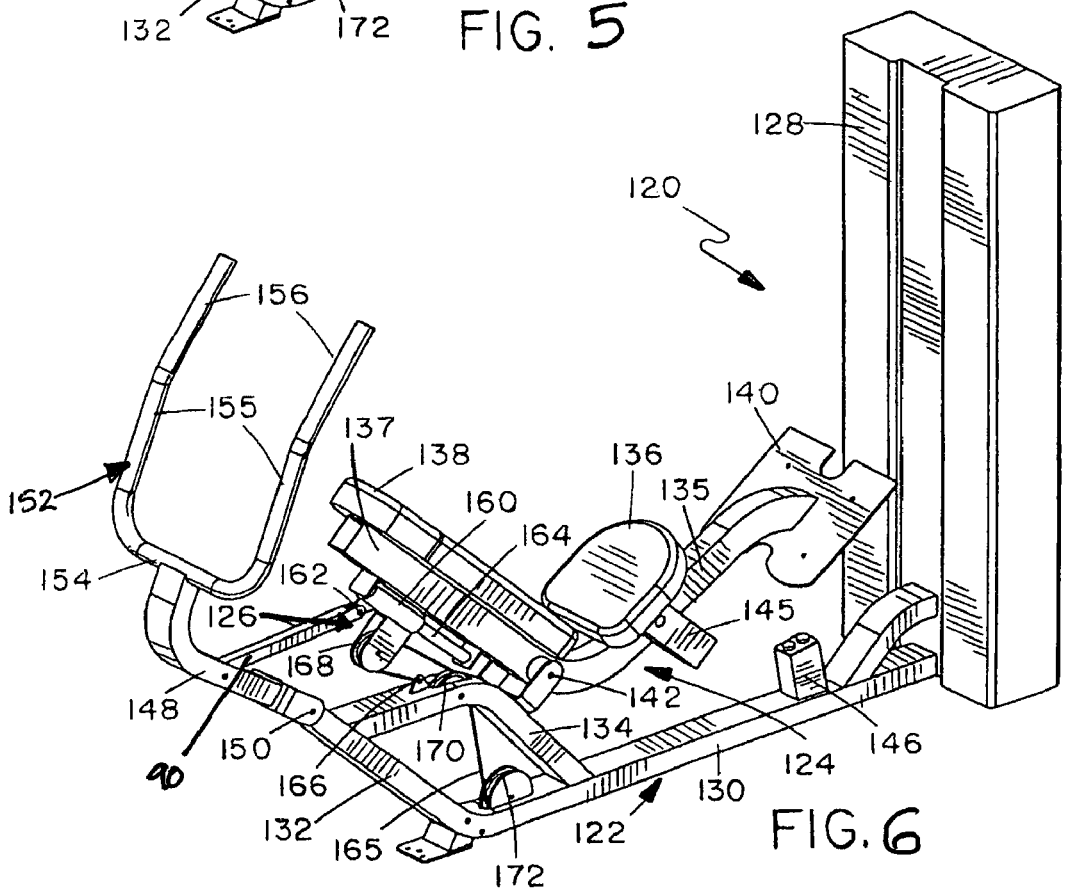
FIG. 6 is a perspective view similar to FIG. 5, illustrating the machine in an exercise ending position.

The exercise arm comprises a first elongate member or strut 148 having one end pivoted to the top of upright frame strut 132 via pivot 150, and a U-shaped member 152 having a central section 154 secured to the opposite end of strut 148 and opposite handle arms 155 extending on opposite sides of the user seat, with user engaging handles 156 at the ends of arms 155, as best seen in FIGS. 5 and 6. The connecting linkage 126 comprises two pivotally connected parts. The first part comprises an arm or link 90 pivoted at one end to rear upright strut 148, and the second part comprises a slide member 160 which is slidably mounted on a third part comprising a rail or guide bar 164 secured to the rear of the user support upright 137. Arm 90 has a first end pivoted to an intermediate point on the first member or strut 148 of the exercise arm via pivot 158 and a second end pivotally secured to the slide member 160 via pivot 162. The slide member 160 is slidably mounted on the rail or guide bar 164 mounted on the rear of the user support upright 137. The slide member 160 is also linked to the exercise resistance, which is a weight stack in this case, via a cable and pulley linkage. A cable 165 extends from an anchor 166 on the pivot mount section 134, over a pulley 168 mounted on the slide member 160, back over a pulley 170 on section 134, over a pulley 172 on the base 130 of the main frame beneath the slide, and then through the frame and into the weight stack housing, where it is linked to a selectorized weight stack in a conventional manner. The multi-part connecting linkage mechanism between the exercise arm and user support frame is similar to that described in U.S. Pat. No. 7,052,444 of Webber, the contents of which are incorporated herein by reference.

Figure 7:
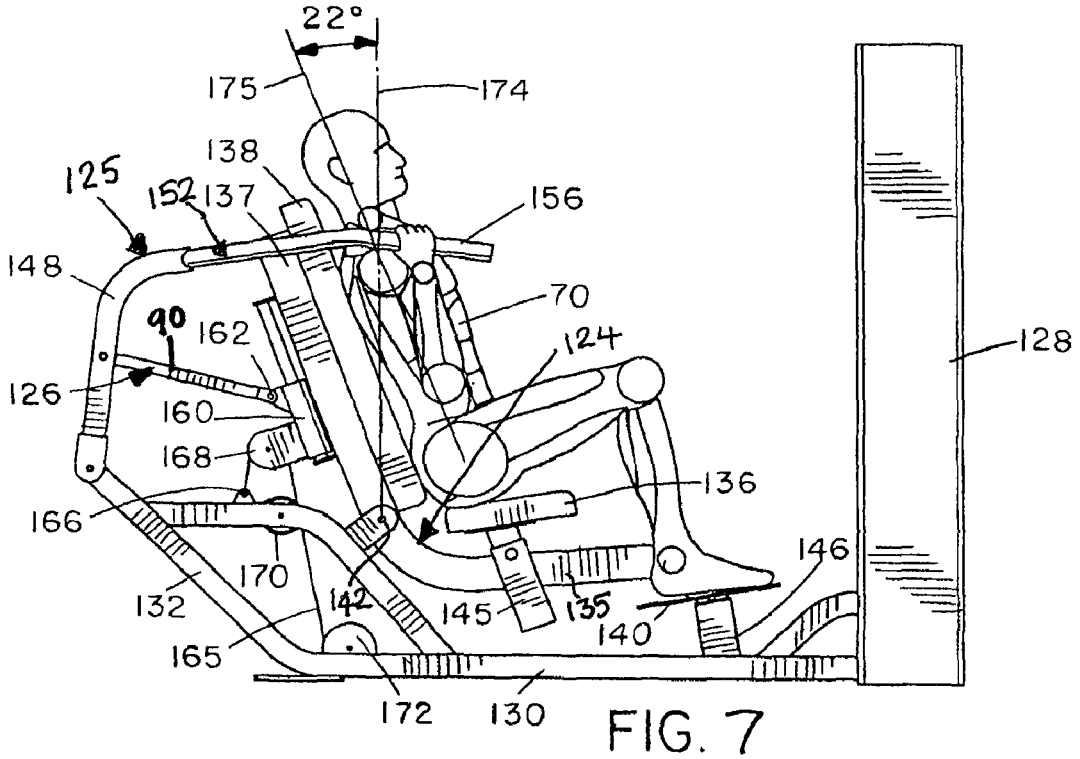
FIG. 7 is a side elevation view of the machine of FIGS. 5 and 6, illustrating an exerciser's body position at the start of the exercise.
Figure 8:
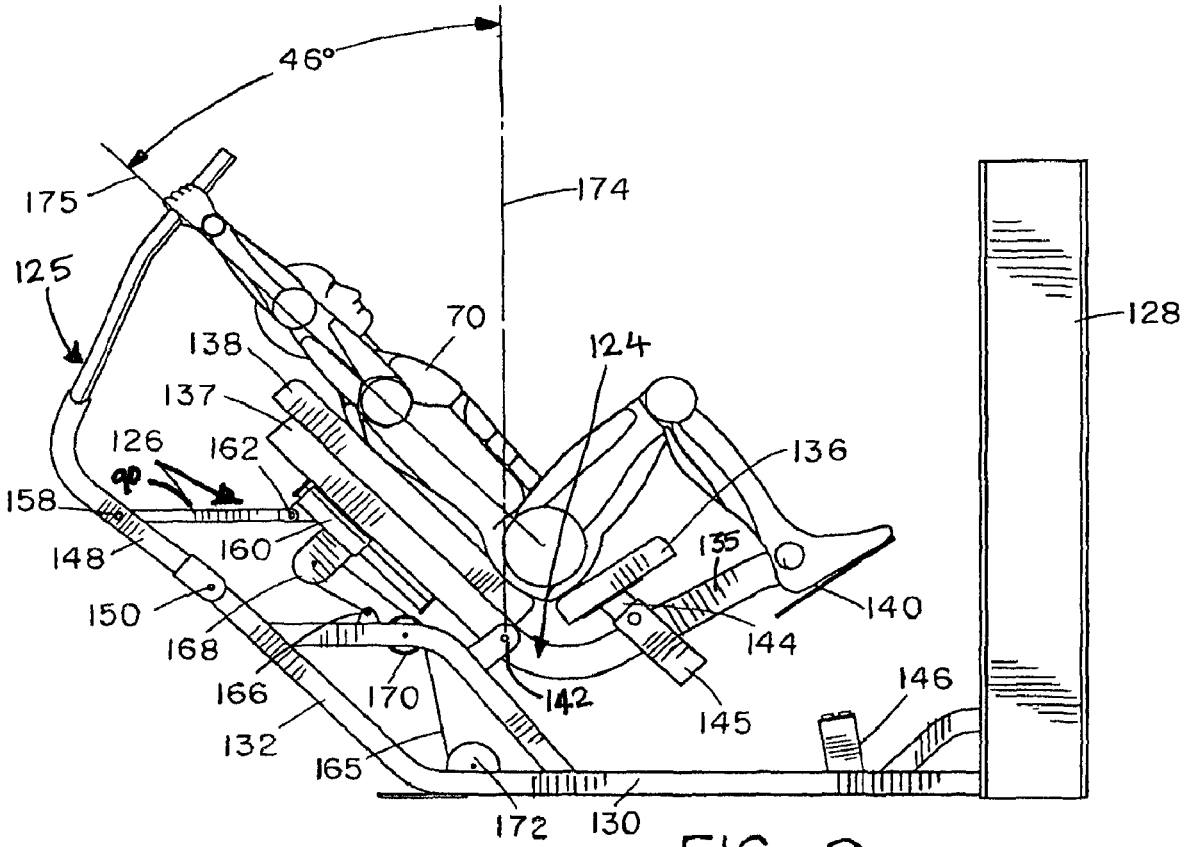
FIG. 8 is a side elevation view similar to FIG. 7, illustrating the exerciser's body position at the end of the exercise.

FIGS. 7 and 8 illustrate a user 70 performing a shoulder press exercise on the machine 120. To perform the exercise, the user sits on the seat in the start position of FIG. 7, where the seat is in a slightly rearwardly reclined position. The user places their feet on the foot rest 140, and grabs the handles 156. In FIGS. 7 and 8, the dotted line 174 represents the gravitational centerline of the user support pivot 142, which is the gravitational centerline of the user performing the exercise. The dotted line 175 represents the side centerline of the exerciser. As can be seen in FIG. 7, the start position places the user in a slightly reclined position, at an angle of around 22 degrees, with their hands at approximately shoulder level and forward of the side centerline of their body. This is equivalent to the start position of the user's body for a free weight shoulder press.

From the position of FIG. 7, the user pushes the handles upwards, rotating the exercise arm rearwardly. At the same time, the exercise arm pulls the first part or arm 90 of the connecting linkage upward, which in turn forces the linear slide member 160 upwards and causes the user support to rotate rearwards about pivot 142. Additionally, upward movement of the slide member lifts the selected weights in the weight stack via the cable and pulley linkage. The user is placed in a back supported position with their hands slightly forward of the shoulders in the start position, and then follows the slight natural arcing movement of a barbell press, finishing the exercise in a substantially reclined position of around 46 degrees to the gravitational centerline, with their arms fully extended and in line with the side centerline 175 of their body, as illustrated in FIG. 8. This substantially mimics the finish position of a free weight shoulder press exercise. The exercise movement provided with this machine therefore mimics the slight, natural arcing movement the arms go through when performing a barbell or dumbbell free weight shoulder press exercise.

As in the previous embodiment, the position of the user support pivot beneath the user's body distributes the weight of the user's body and the support frame on both sides of the gravitational centerline in both the start and finish position of the exercise. The starting position in this case places the user support pivot rearward of the exerciser's hips, with the gravitational centerline 174 in line with the centerline of their shoulders. While the majority of the user's body starts forward of the gravitational centerline, the user will rotate rearwards through this centerline during the exercise, and finish with the centerline bisecting the middle of their torso for a more evenly balanced distribution of weight at the end of the exercise. The combined weight of the user and user support will still have a reduced effect on the amount of starting resistance, since part of the user's weight is still placed rearward of the user support pivot, acting as a counterbalance to the exercise arm. By the same token, as the user passes rearward through the gravitational centerline, there is no appreciable drop off in resistance felt because of the amount of weight which still remains forward of centerline 174.

Also as in the previous embodiment, this machine fully supports the exerciser throughout the exercise movement so that they do not have to worry about balance and coordination, unlike a free weight exercise. The exercise arm and user support are linked to one another to self-align throughout the exercise movement, so that the handles can be angled for a more comfortable start and finish position.

Figure 10:
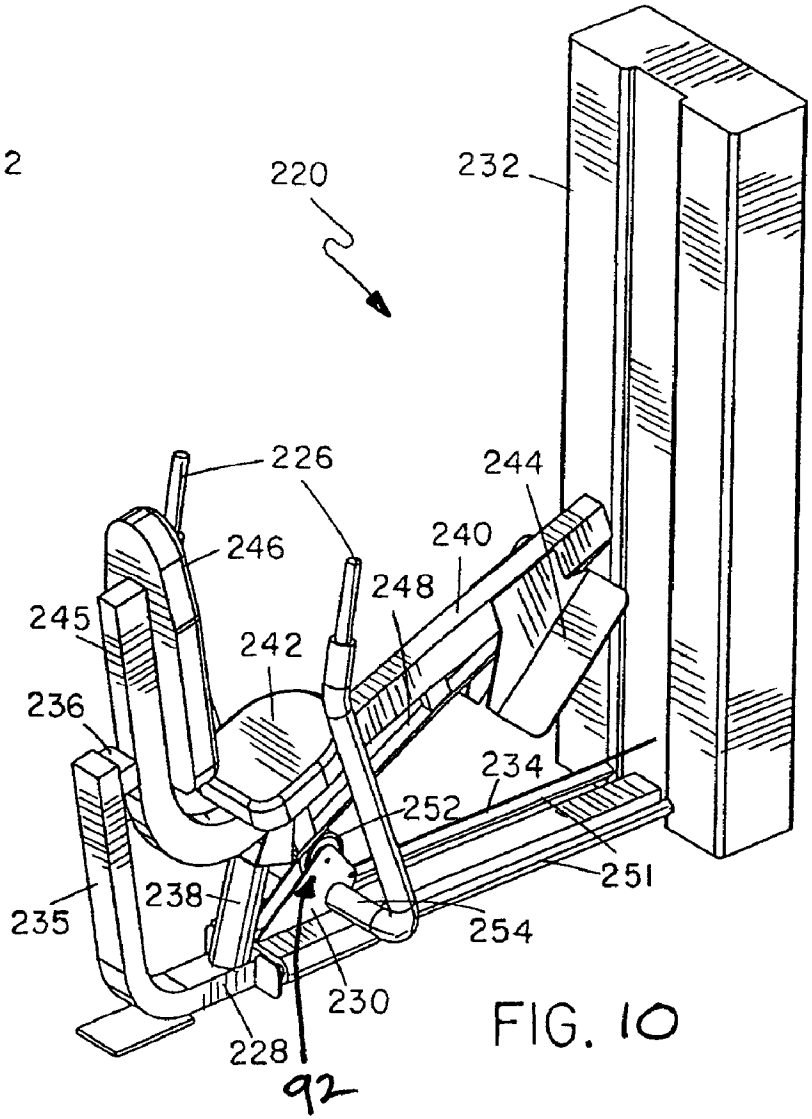
FIG. 10 is a rear perspective view similar to FIG. 9, illustrating the machine in an exercise ending position.
Figure 9:
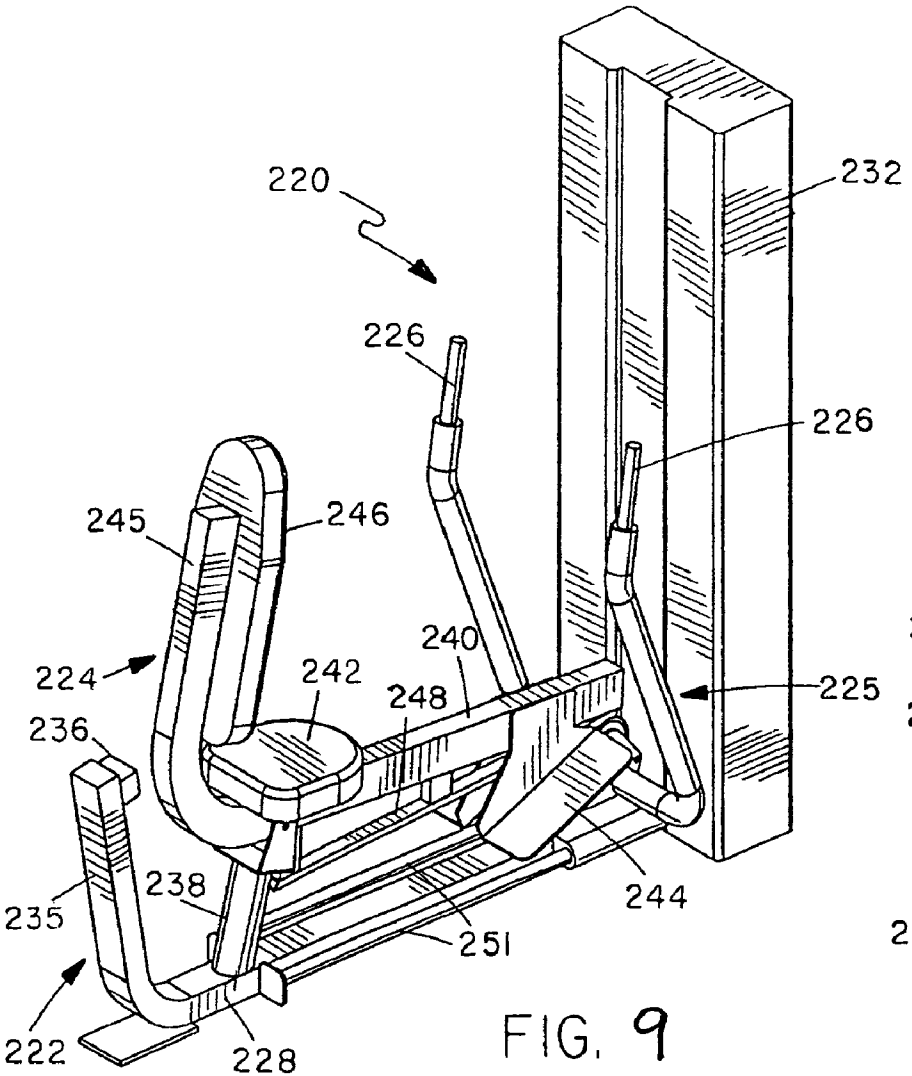
FIG. 9 is a rear perspective view of a mid-row exercise machine according to another embodiment for performing rowing exercises, with the machine illustrated in a start position adopted at the beginning of an exercise movement.
Figure 11:
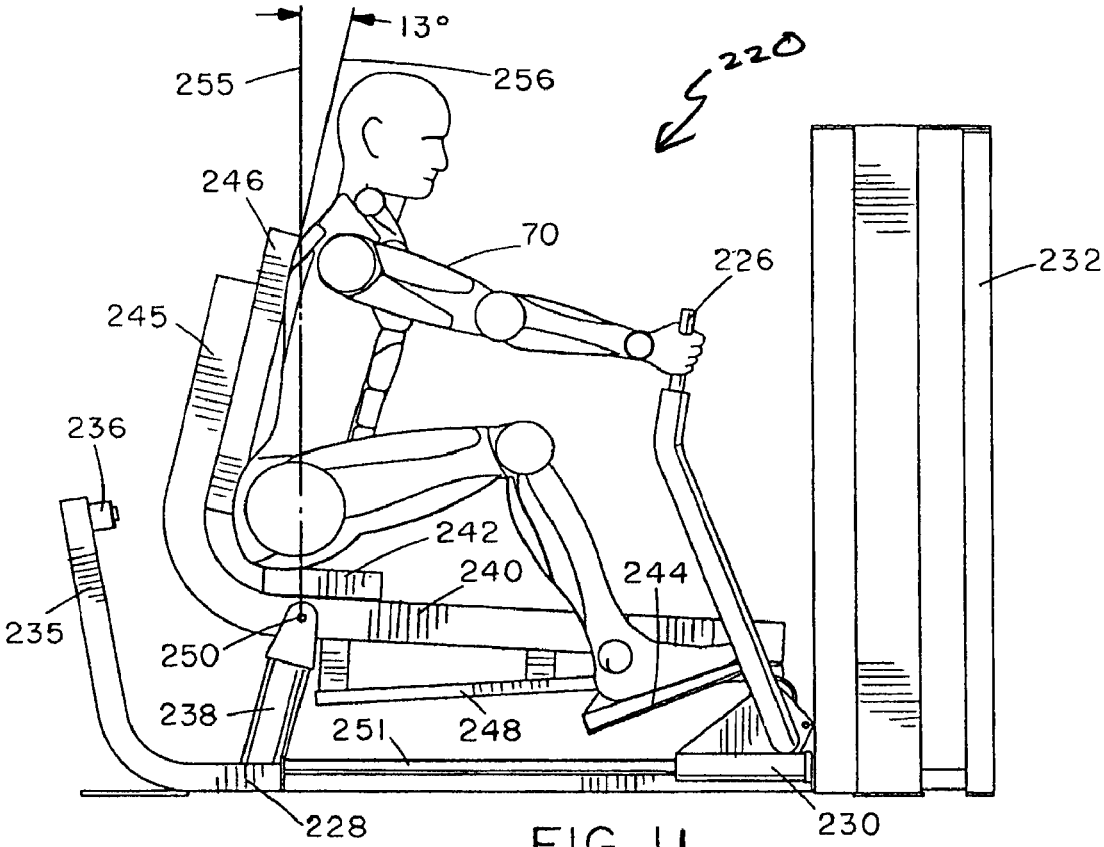
FIG. 11 is a side elevation view of the machine of FIGS. 9 and 10, illustrating an exerciser's body position at the start of the exercise.
Figure 12:
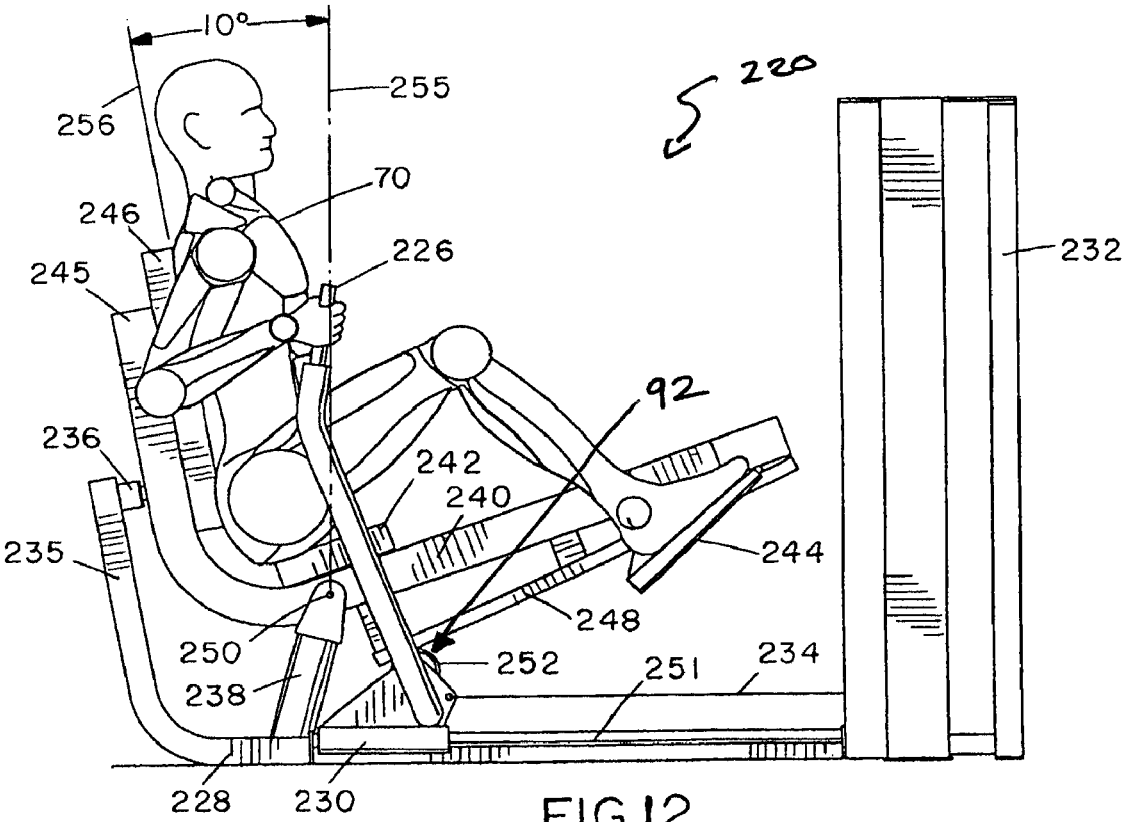
FIG. 12 is a side elevation view similar to FIG. 11, illustrating the exerciser's body position at the end of the exercise.

FIGS. 9 to 12 illustrate a mid row exercise machine 220 according to another embodiment, for performing a rowing exercise equivalent to a free rowing exercise. FIG. 9 illustrates the machine in a start position while FIG. 10 illustrates the finish position, with FIGS. 11 and 12 illustrating the same positions with a user 70 performing the exercise.

The exercise machine 220, as in the previous embodiments, comprises a main frame 222, and a user support 224 pivotally mounted on the frame. In this case, a U-shaped exercise arm 225 with handles 226 at its free, upper ends is slidably mounted on the base 228 of the frame 222 via linear slide 230. The linear slide 230 is linked to an exercise resistance, in this case a weight stack in housing 232, via a cable and pulley linkage, most of which is concealed within the weight stack housing, with the cable 234 of the linkage connected to the slide 230 as indicated. The linear slide or sliding wedge 230 forms one part of a multi-part connecting linkage 92 which translates movement of the exercise arm 225 into movement of the pivotally mounted user support 224. A roller 252 rotatably mounted on an upper part of wedge 230 forms a second part of the linkage, and engages a rail or track 248 secured to the user support 224, as described in more detail below. The multiple part connecting linkage between the exercise arm and user support is similar to that described in U.S. Pat. No. 6,916,278 of Webber, the contents of which are incorporated herein by reference.

The main frame also has a slightly rearwardly inclined upright strut 235 at the rear end of base 222, which has a stop pad 236 at its upper end forming a rest for the user support in the finish position of FIGS. 10 and 12, and a pivot mounting post 238 extending upwardly from the base at a position spaced forwards from upright strut 235. The user support 224 is generally L-shaped, and has a base 240 on which a seat pad 242 is mounted, with a pair of foot rests or foot plates 244 secured adjacent the forward end of base 240, and an upright 245 supporting back pad 246. Guide bar or track 248 is mounted on the underside of the base 240 of the user support so as to extend at an upwardly inclined angle from the rear end to the forward end, as best illustrated in FIGS. 11 and 12. The user support is pivoted to the pivot mount 238 via a pivot 250 located beneath the seat pad 242.

The linear slide or wedge 230 of the connecting linkage 92 is slidably engaged on a pair of parallel, linear guide bars 251 on the base 228 of the frame, as best illustrated in FIG. 10, and the wheel 252 at its upper end is in rolling engagement on the guide bar or track 248 on the underside of the user support base. The central portion 254 of the U-shaped exercise arm is mounted on the slide or wedge 230, as best illustrated in FIG.

10. Rearward linear motion of the exercise arm is translated into rearward rotational movement of the user support with this arrangement.

FIGS. 11 and 12 illustrate a user 70 performing a rowing type of exercise, also known as a mid row exercise, on the machine 220. In FIGS. 11 and 12, dotted line 255 is the gravitational centerline of the user support pivot 250, while dotted line 256 represents the orientation of the user support back rest, or the back of the user when seated on the support. To perform the exercise, the user sits on the seat with the user support in the position illustrated in FIG. 11, and places their feet on the foot support plates 244 while gripping handles 226 with their arms straight out in front. The user support is initially positioned in a back supported, forwardly inclined position, so that the user's body is initially at a forward lean of around 13 degrees off vertical. The user's arms extend straight forwards with their hands slightly below shoulder level, which is equivalent to the starting position for a free rowing exercise.

The user then pulls handles 226 towards their body in a rowing action, simultaneously pulling the slide or wedge 230 along the rails 251. This wedges the wheel 252 along the angled user support guide bar 248, rotating the user support rearwardly about pivot 250, and moving the user from a slightly forwardly inclined position to a reclined position, ending with their arms pulled back and their hands at a slightly lower elevation, relative to their shoulders, than the starting position. This follows a natural rearward arcing rowing motion. The end position of the user in FIG. 12 is similar to the end position for a free rowing exercise. This exercise machine mimics the slight, naturally arcing movement of the upper body when rowing a boat or exercising on a rowing machine, without allowing the user to bend at the waist, which is undesirable and can occur with a free rowing exercise.

In the exercise machine of this embodiment, the user support pivot 250 is positioned directly under the exerciser. The gravitational centerline 255 runs very close to the centerline of the user's hip, allowing a balanced portion of the user and user support to be positioned on each side of the gravitational centerline in both the start and finish position. Because the user support seat 242 rises upward as it rotates and the exercise arm travels in a straight line, the positioning of the exerciser's hands, relative to their shoulders, will be slightly higher in the starting position than the finish position. This involves more of the back muscles in one exercise, which is not possible with a conventional rowing machine exercise using a cable.

Figure 13:
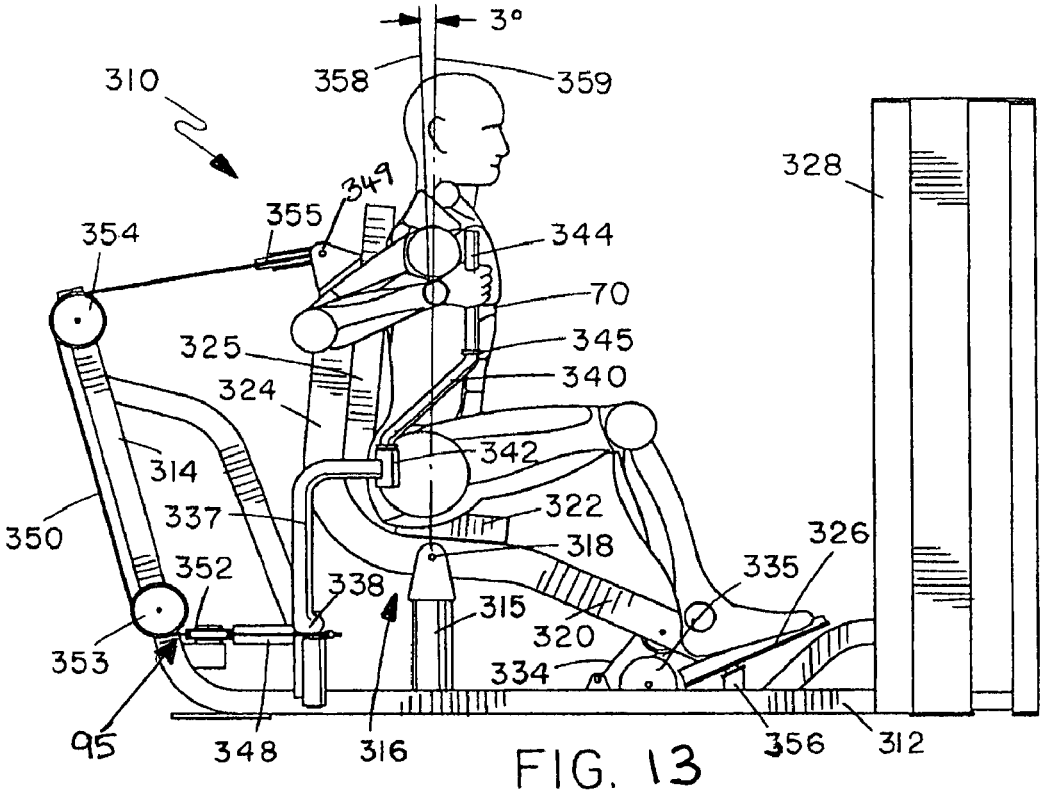
FIG. 13 is a side elevation view of a pec fly exercise machine according to another embodiment for performing fly type exercises, with a user seated on the machine in a start position adopted at the beginning of an exercise movement.
Figure 14:
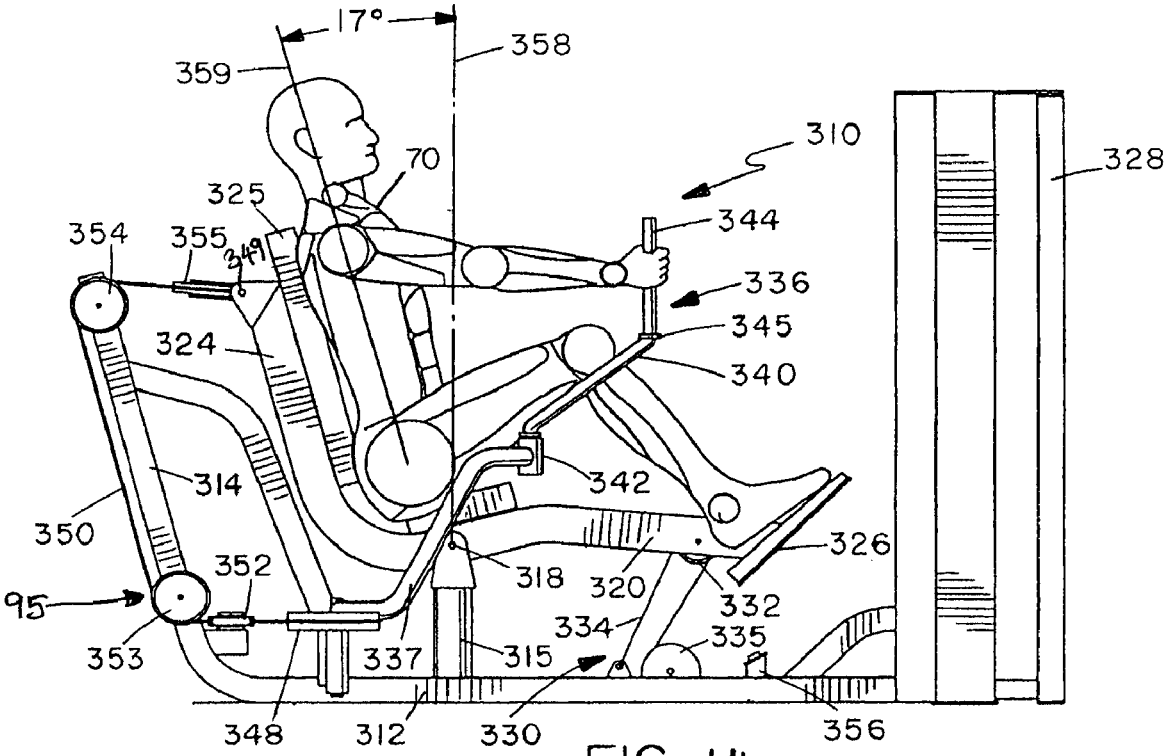
FIG. 14 is a side elevation view of the machine of FIG. 13, illustrating the user and machine in an exercise ending position.
Figure 15:
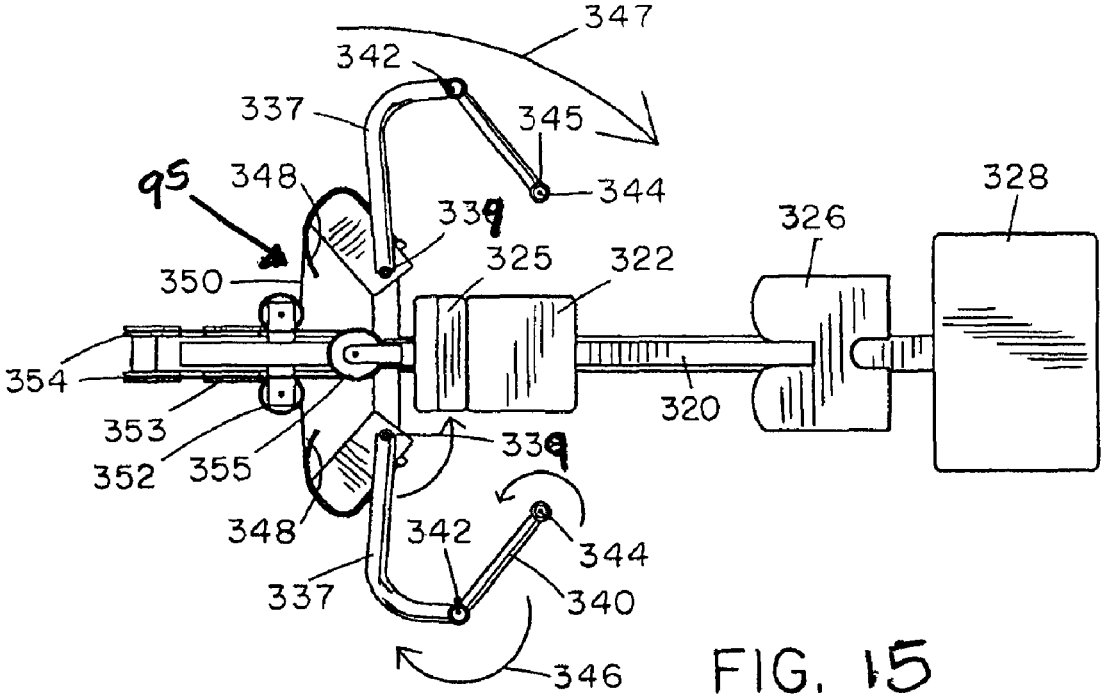
FIG. 15 is a top plan view of the exercise machine of FIG. 13 in the start position.
Figure 16:
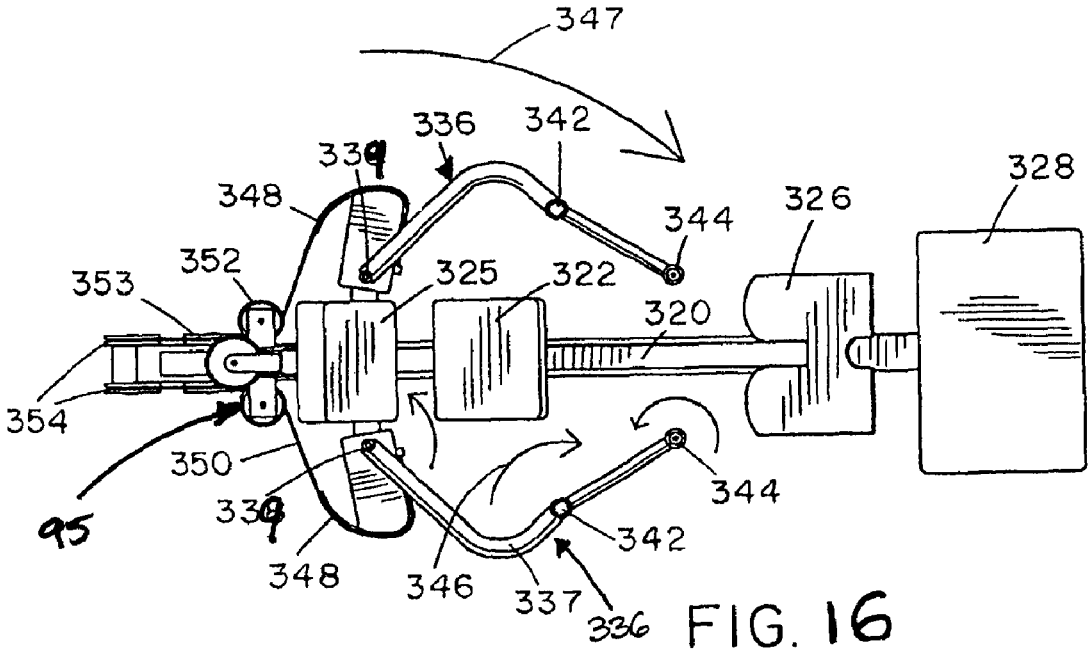
FIG. 16 is a top plan view similar to FIG. 15, illustrating the exercise end position.

FIGS. 13 to 16 illustrate a pectoral fly ("pec fly") exercise machine 310 according to another embodiment for performing pec fly exercises. A free weight pectoral fly exercise may be performed in a straight position on a horizontal bench, in a decline position on a downwardly reclined back rest or bench, and in an incline position on an upwardly inclined back rest, in order to carry out straight, decline and incline pectoral fly exercises, involving different muscles. The pectoral fly machine of this embodiment is designed to combine all three pectoral fly exercises in one machine, as described in more detail below. FIGS. 13 and 15 illustrate the start position of the exercise, while FIGS. 14 and 16 illustrate the end position, with FIGS. 13 and 14 illustrating a user 70 performing a pectoral fly exercise on the machine.

The machine of FIGS. 13 to 16 has a similar base frame and user support arrangement to the mid row machine of FIGS. 9 to 12. However, the exercise arm and connecting linkage arrangement is different. The pec fly machine 310 has a main frame comprising a base section 312, a rear upright 314, and a pivot mounting post 315 on the base section. A generally L shaped user support 316 is pivotally mounted on the pivot mounting post 315 via pivot 318. The user support 316 has a base 320 on which a seat pad 322 is mounted, and an upright 324 on which back pad 325 is mounted. A foot rest or foot plate 326 is mounted at the forward end of the base 320. An exercise resistance comprising a selectorized weight stack in housing 328 is linked to the base of the user support via a cable and pulley linkage 330, including a pulley 332 at the forward end of the base 320 adjacent the foot plate, and a cable 334 extending from an anchor on the base of the main frame, around pulley 332, around a second pulley 335 on the frame base, and then into the weight stack housing to extend around additional guide pulleys before linking to the weight stack in a conventional manner.

A pair of multi-part, articulating exercise arms 336 are rotatably mounted via pivot shafts 338 at their first ends on the base section 312 of the main frame, one on each side of the user support, as best illustrated in FIGS. 15 and 16. Each exercise arm 336 has a first elongate part 337 having a pivot shaft 338 at one end which is pivotally mounted on the frame for rotation about pivot axis 339. An elongated handle 340 has a first end rotatably mounted on the second end of part 337 for rotation about pivot axis 342. A user-engaging grip 344 is rotatably mounted on the second end of handle 340 for rotation about pivot axis 345. The pivotal connection between each handle and the respective exercise arm allows the handles to rotate inwardly and outwardly relative to their attachment to the exercise arms, as indicated by arrows 346 in FIGS. 15 and 16, so that the combined movement of the exercise arm and elongated handle about pivot axes 339 and 342 results in forward and rearward elliptical travel paths (see arrow 347).

A resistance cam 348 is mounted on each pivot shaft 338. A multi-part connecting linkage 95 connects each cam 348 to the user support in order to translate movement of the exercise arm into movement of the user support. The multi-part connecting linkage in this embodiment comprises a cable and pulley assembly extending between the user support and the exercise arms or user engagement device and includes a swivel or pivot connection 349 to the user support. The cable and pulley assembly comprises a cable or flexible link 350 and a plurality of pulleys on the main frame and the user support defining a path for the cable from each exercise arm to the user support. Cable 350 has a first end attached to a cam 348 of a first exercise arm, and extends over a first series of pulleys 352, 353, 354 mounted on the rear upright of the main frame, a swivel pulley 355 pivotally mounted at the upper end of the user support frame at pivot connection 349, and then around a second series of pulleys 354, 353, 352 on the opposite side of the rear upright, before attaching to the cam 348 of the second exercise arm, as best seen in FIG. 15. This provides the connecting linkage between the user support and exercise arm, and ensures that forward rotational movement of one or both exercise arms results in rearward rotational movement of the user support.

FIG. 13 illustrates a user 70 seated on the user support with the exercise machine in the start position. The user sits on the seat in a slightly forwardly inclined position, and places their feet on foot pad 326, which rests on a support post 356 on the base of the frame in the start position. They grab the hand grips 344 and push the hand grips and associated exercise arm forwards into the end position of FIGS. 14 and 16. In the start position, the user's upper body is inclined forwardly at an orientation of around 3 degrees to the gravitational centerline 358, with line 359 of FIG. 13 indicating the side centerline of the user's upper body. Gravitational centerline is the perpendicular or vertical centerline through the user support pivot 318. The user's elbows are bent with the arms out to the side and the hands slightly below the shoulders, mimicking the start position of the arms for a free weight pec fly, while the body is forwardly inclined, in position for an incline pectoral fly. Pushing the exercise arms forward causes the cams 348 mounted on the exercise arm pivot shafts to rotate, which pulls the cable 350 reeved around the swivel pulley 355 mounted at the upper end of the user support. This causes the user support 316 to pivot rearward about pivot 318 against the exercise resistance linked to the forward end of the user support. This action moves the user from a forwardly inclined position to a slightly reclined position, ending with their arms extending forward in front of their body, similar to the ending position of the arms for a free weight pec fly exercise while the body is in a decline pec fly position.

FIGS. 15 and 16 illustrate the movement of the three parts of each articulating exercise arm, comprising the first parts, elongated handles, and user-engaging grips, from the start to the end position of the exercise. The three pivot axes 339, 342 and 345 replicate the joint movement of the shoulder, elbow, and wrist, respectively, when performing a free weight pectoral dumbbell fly exercise.

The user support pivot 318 is positioned directly under the user in this exercise machine, as in the previous embodiments. In this case, the gravitational centerline 358 runs very close to the centerline of the user's hip, allowing a balanced portion of the user support and user to be positioned on each side of the line 358 in both the start and end position. Because the user support seat rises upward as it rotates while the exercise arms remain in the same horizontal plane, the positioning of the user's hands, relative to their shoulders, will be slightly higher in the start position than the end position. This, coupled with the fact that the user is in all three pectoral fly positions (decline, flat/straight, and incline) during the exercise, allows this exercise machine to combine all three possible pectoral fly exercises in one exercise movement for greater muscle involvement. In the start position, the user is in an incline pectoral fly position, and travels through a flat or straight pec fly position during the exercise, finishing the exercise in a decline pectoral fly position. This produces an enhanced workout which saves time and money, because three machines or exercise stations providing three pec fly exercises are combined into one.

Figure 17:
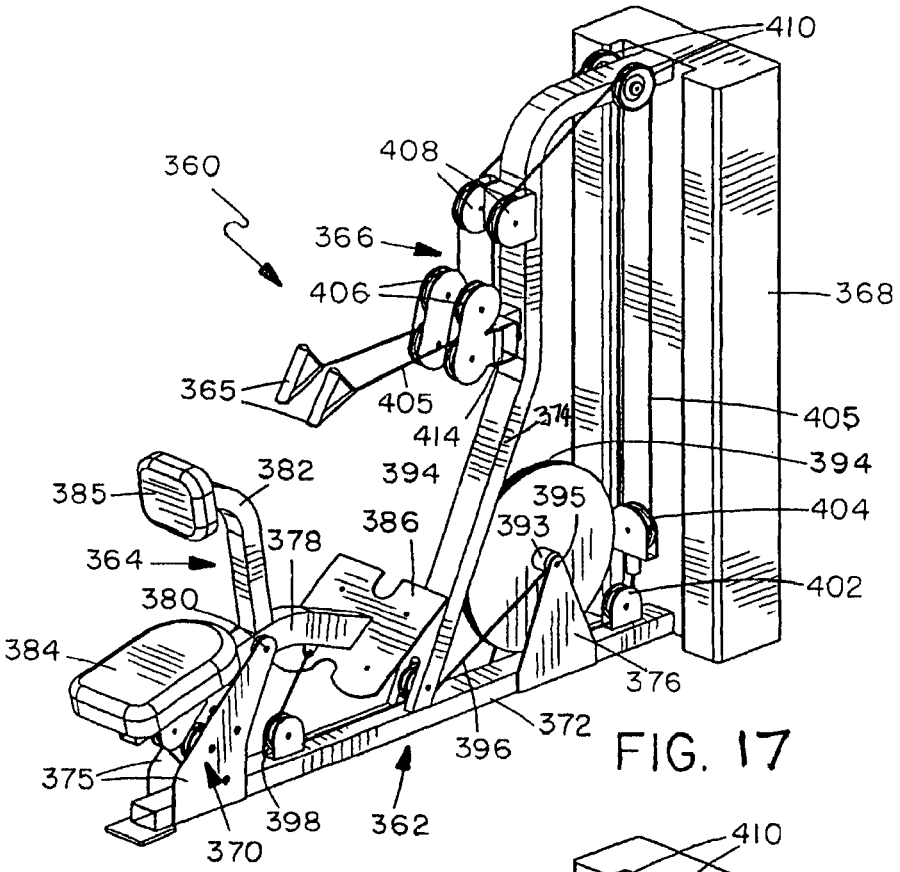
FIG. 17 is a rear perspective view of an upper back exercise machine according to another embodiment, with the machine illustrated in a start position adopted at the beginning of an exercise movement.
Figure 18:
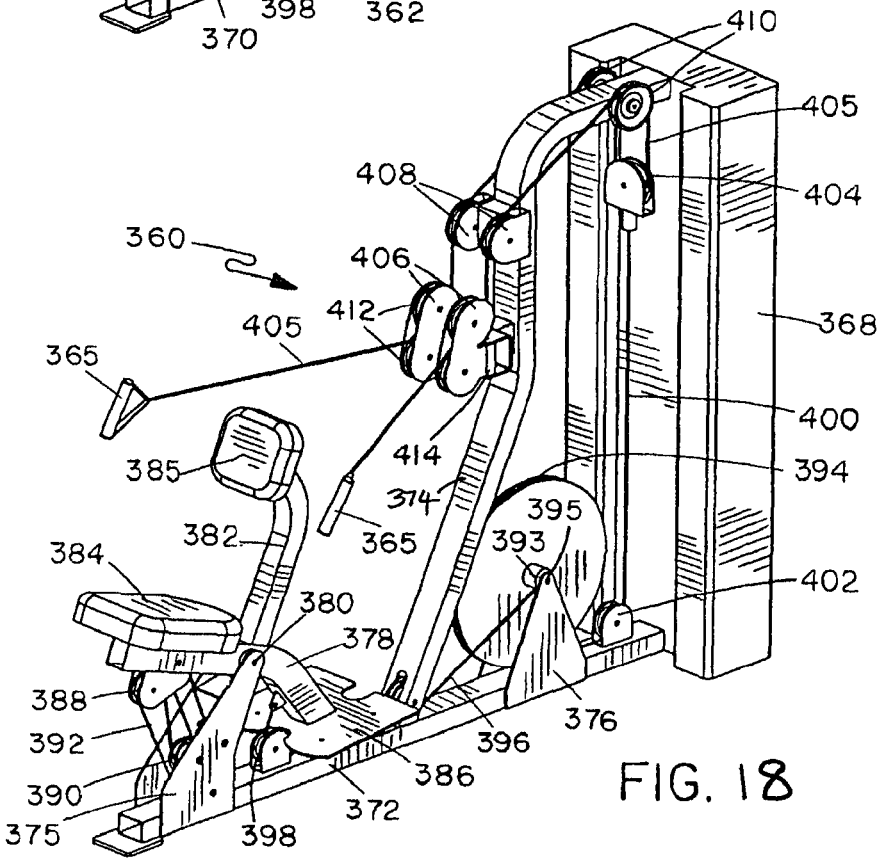
FIG. 18 is a rear perspective view similar to FIG. 17, illustrating the machine in an exercise ending position.
Figure 19:
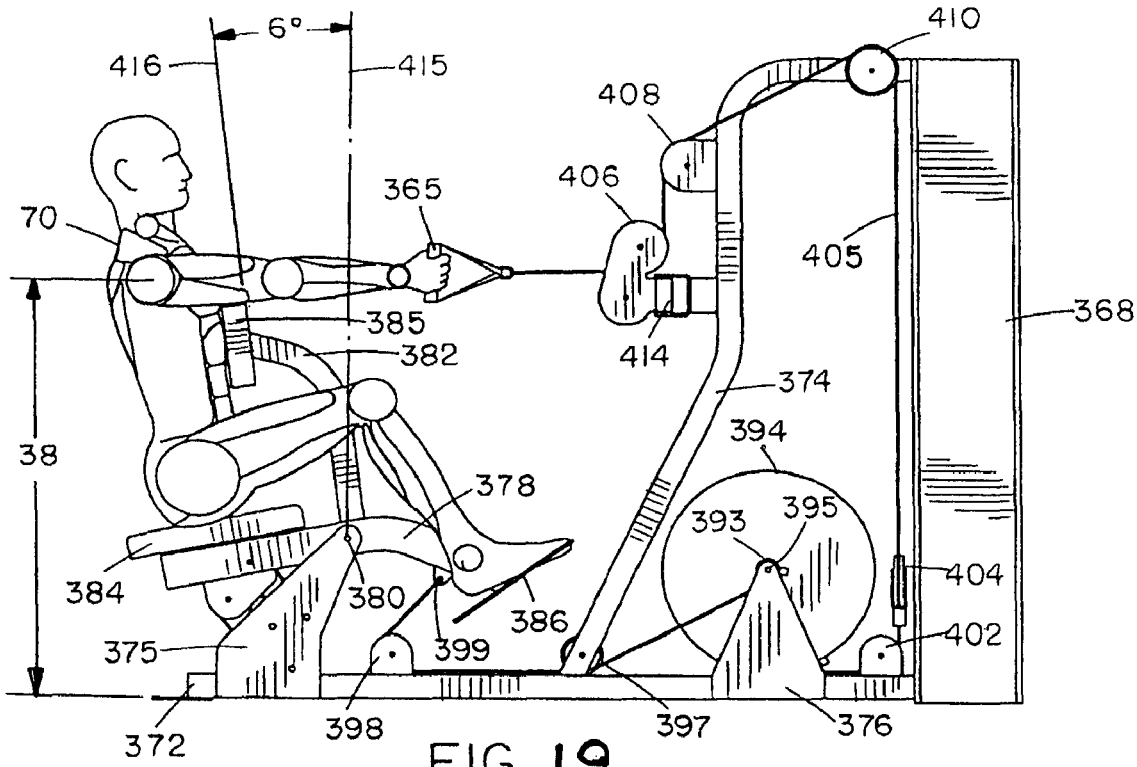
FIG. 19 is a side elevation view of the machine of FIGS. 17 and 18, with a user seated on the machine in the start position adopted at the beginning of the exercise.
Figure 20:
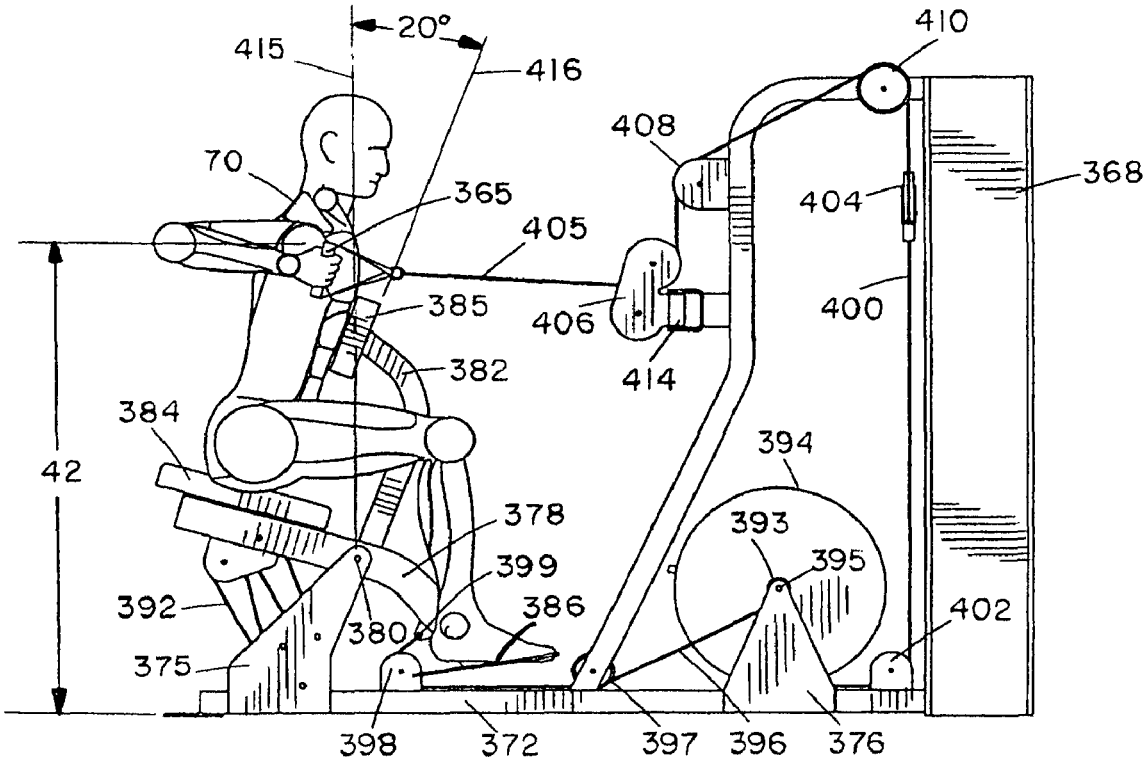
FIG. 20 is a side elevation view similar to FIG. 19, illustrating the user and machine in the end position of the exercise.

FIGS. 17 to 21 illustrate an exercise machine 360 according to another embodiment for performing upper back exercises. FIG. 17 illustrates the machine in a start position while FIG. 18 illustrates the machine in an end position for the exercise, with FIGS. 19 and 20 illustrating the same start and finish positions with a user seated on the machine.

The machine 360 has a main frame 362, a user support frame 364 pivotally mounted on the main frame, a user engagement device having user engaging handles 365 attached to opposite ends of a cable or flexible exercise arm member 405 extending around a series of pulleys in cable and pulley assembly 366, an exercise resistance comprising a weight stack in housing 368 linked to the user support frame via a second cable and pulley assembly 370, and a multiple part connecting linkage extending from the user engagement device to the user support frame. In this embodiment, the multiple part connecting linkage comprises a dual cam assembly 393, 394 and first and second cables or flexible links 400, 396 extending between cable 405 of the user engagement device and a forward end of the user support frame, as explained in more detail below. The flexible links 400, 396 may comprise any suitable flexible elongate members such as cables, belts, lines, chains and the like.

The main frame 362 comprises a horizontal base section 372, an upright section 374, user support pivot mount plates 375 extending upwardly at the rear end of the base section, and a pair of cam pivot mounting plates 376 extending upwardly from the base section between the upright section 374 and the weight stack housing 368.

The user support frame 364 is generally T-shaped, with a base 378 pivotally mounted between the upper ends of the pivot mount plates 375 via pivot pin 380, and an upright post 382 which curves rearward at its upper end. A user support seat pad 384 is mounted on the rear part of the base, while a chest support pad 385 is mounted at the upper end of post 382. A foot support or footplate 386 is secured to the forward end of the base 378. The rear part of the base 378 is linked to the weight stack via the second cable and pulley assembly 370. As best illustrated in FIG. 18, cable and pulley assembly 370 comprises a set of pulleys 388 mounted on the undersurface of base 378, a set of pulleys 390 mounted between the pivot mounting plates 375, and a cable 392 extending from an anchor back and forth over the two sets of pulleys, and then running through the base 372 into the weight stack housing where it extends over further pulleys (not visible in the drawings) before linking in any conventional manner with the weight stack.

The forward end of the user support frame is linked to the user engaging handles via the connecting linkage 396, 393, 394, and 400, and the first cable and pulley assembly 366. The connecting linkage includes first and second cam portions 393, 394 of different diameter or profile mounted on a pivot shaft 395 rotatably mounted between the upper ends of cam plates 376. The forward end of the user support base 378 is linked to the first, smaller cam 393 by cable 396 extending from the cam around a pulley 397 at the lower end of upright 374, around a second pulley 398 on the frame base beneath the user support base, and tied off at anchor 399 on the underside of the base 378 close to the footplate 386.

A second cable 400 extends from the second, larger cam 394 around a fixed pulley 402 at the forward end of base 372 and is anchored to the housing of a floating pulley 404. As noted above, the user engagement device in this embodiment comprises the handles 365 and flexible cable 405 which has opposite ends secured to the respective handles 365. Cable 405 extends from one handle between pulleys 412 of one set of a pair of swivel pulley assemblies 406 mounted on upright 374, around one of a pair of fixed, side-by-side pulleys 408 on the upright above the swivel pulley assemblies 406, around one of a pair of parallel pulleys 410 on opposite sides of an upper, generally horizontal portion of the upright 374, and then downwardly around the floating pulley 404. From the pulley 404, cable 405 extends back up around the second one of the pulleys 410, around the second one of the pulleys 408, and is then reeved between the two pulleys 413 in the second set of the swivel pulley assemblies 406, before connecting to the second handle 365. With this arrangement, rearward movement of one or both handles pulls up the floating pulley 404, rotating the cams 393,394. Cables 396 and 400 are oppositely connected to the respective cam portions 393 and 394 so that pulling on handles 365 unwinds cable 400 from cam portion 394 while winding cable 396 onto cam portion 393, rotating the user support frame upwardly about pivot 380. Handles 365 may be activated together or independently.

Figure 21:
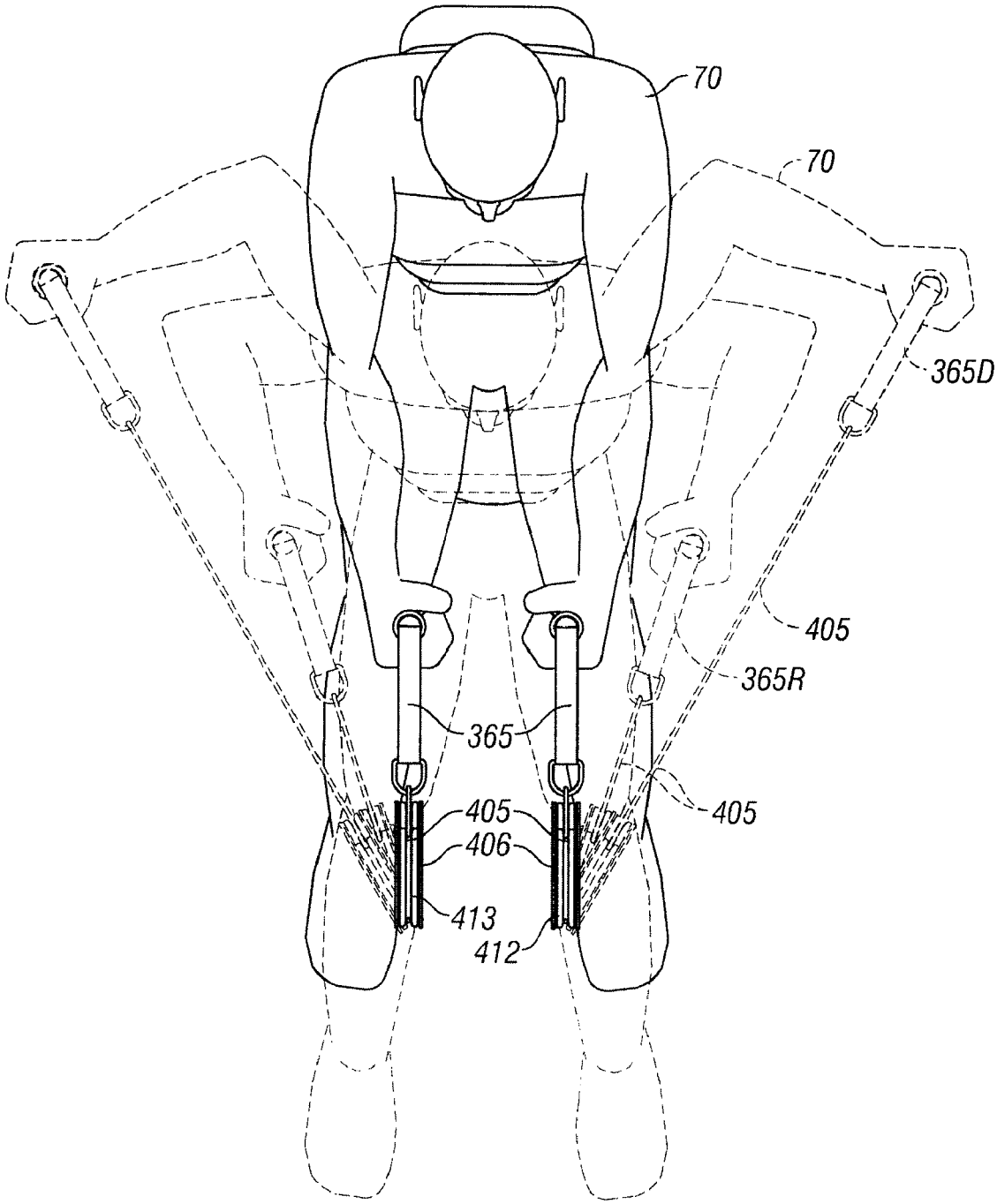
FIG. 21 is a top plan view of part of the user engaging handle part of the machine of FIGS. 17 to 20, with a seated user engaging the handles, illustrating user defined movement of the handles to perform different upper back exercises.

The swivel mounts 414 of the two swivel pulley assemblies 406 allow the assemblies to pivot in and out as indicated in FIG. 21 as the user moves their hands in an exercise movement which exercises the upper back muscles. This allows the user to control the exercise path, as indicated in FIG. 21 and described in more detail below. In order to perform the exercise, the user 70 first sits on the user support in the position of FIG. 19 and the solid line position of FIG. 21, placing their feet on the footplate 386, their chest against the chest pad 385, and grabs the handles 365 with their arms straight in front of their body, slightly bent, and their hands close together, as indicated in FIG. 19 and in solid lines in FIG. 21. At the start of the exercise, the user is in a slightly reclined orientation at an angle of around 6 degrees to the gravitational centerline 415 or vertical centerline of the user support pivot 380, as indicated in FIG. 19, where the second dotted line 416 indicates the orientation of the chest pad 385 or front of the user's chest.

From the position illustrated in FIG. 19, the user pulls the handles or hand grips 365 rearward. Since the exercise arm in this embodiment is a flexible cable 405 which extends from each handle between the pulleys of a respective set of swivel pulley assemblies 406 which can swivel inward and outward, the user controls the exercise path and thus the type of upper back exercise performed. In FIGS. 19 and 20, the user is shown performing a rear deltoid exercise in which the user moves their hands rearward and outward into an end position in which the user's arms are bent with their hands positioned out to the sides of their body, as illustrated in the outermost dotted line handle position 365D of FIG. 21. As noted above, this movement also pulls the user support upwardly against the exercise resistance, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 365. These factors together provide an enhanced workout by involving a greater number of muscles than a rear deltoid exercise performed in only one position, thereby combining multiple exercises into one. Instead of performing a rear deltoid exercise, a user may chose to perform a mid-row type of exercise, pulling their hands back and only slightly outwards, with the handles or grips 365 ending in dotted line position 365R of FIG. 21. The user may define the travel path of the grips as desired throughout the exercise and may end the exercise with the handles in either of the positions illustrated in FIG. 21, or in any other desired position. This embodiment therefore permits the user to determine or define the exercise which is performed by altering the path of their hands during the exercise.

The gravitational centerline or vertical centerline 415 of the user support pivot runs through the exerciser's thigh, just behind the knee in the start position and ending at mid thigh in the finish position of the rear deltoid exercise illustrated in FIGS. 19 and 20. When the user performs the mid-row exercise ending with the handles at position 365R of FIG. 21, the user and user support are positioned slightly to the rear of the position illustrated in FIG. 20 at the exercise finish or end position. In either case, there is a balanced distribution of weight on each side of the centerline 415 both at the start and end position, minimizing the effect that the weight of the exerciser and user support has on the exercise resistance. The amount of weight positioned on each side of centerline 415 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

In this embodiment, the user engagement device comprises handles attached to a flexible line or cable 405, to provide a unilateral, three dimensional user defined exercise motion. The machine is designed to mimic the natural elliptical movement of the corresponding free weight dumbbell exercise, but is able to combine the effectiveness of multiple exercises by rotating the user from reclined to flat to inclined positions throughout the exercise. The connecting linkage 396, 393, 394, 400 which translates movement of the user engagement device into movement of the user support frame is partially flexible and includes at least two axially spaced cams or cam portions rotatably mounted about the same cam axis 395, arranged so that one cable or flexible link wraps around one of the cam portions while the other unwraps. Pulling on the handles or grips 365 in this machine rotates the dual cam assembly in a first direction (anti-clockwise as viewed in FIGS. 19 and 20), unwinding cable 400 from the larger cam 394, while winding a smaller amount of cable onto the smaller cam 393. Cams or separate cam portions of different relative diameters can be selected in order to change the ratio between handle movement and user support frame movement, depending on the desired end position for the user support frame.

In each of the above embodiments, the user engagement device, which comprises a rigid exercise arm or handles attached to a flexible line, is linked to the user support so that movement of the user engagement device produces movement in the user support. The connecting linkage is a multipart linkage which translates movement of the user engagement device to movement of the user support. The connecting linkage may be a partially flexible linkage including one or more cables extending around pulleys, or may comprise multiple rigid parts which are pivotally or telescopically secured together and pivotally or slidably engaged with two or more of the main frame, user engagement device, and user support frame. The user engagement device may include a flexible cable extending around pulleys on the main frame, an articulated exercise arm, or a rigid exercise arm movably associated with the main frame or user support frame.

In each of the above embodiments, movement of the user support is linked to movement of the exercise arm or user engagement device and the user support pivot or theoretical pivot is positioned so that the combined weight of the user support and user is distributed on both sides of the gravitational centerline of the pivot, and the user support provides a counter-balancing effect on the exercise arm as it moves and its weight is re-distributed. This balanced weight distribution positions a portion of the user and user support on each side of the gravitational centerline in at least one of the start and finish positions. As the exercise arm is moved, a portion of this combined weight passes through the gravitational centerline redistributing the weight. This re-distribution is gradual and continuous throughout the exercise motion and is not noticed by the user.

In the exercise machines described above, operation of the user engagement device causes a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used. The exercise arm could be unidirectional or bi-directional, may be rigid or flexible, may be in one piece (dependent) or two pieces for independent arm movement, and may provide two dimensional or three dimensional movement. The exercise arm may be mounted on the user support, main frame, or connecting linkage, and the exercise arm movement may be rotational or linear. In some embodiments, the exercise arm is designed to allow user-defined or user-determined exercise movement. Different user engaging handles may be used, providing rigid or flexible, fixed, or self-aligning hand movement, without affecting the overall function of the machines.

The user support and user engagement device could be designed to travel in the same or opposite directions. The user support pivot mount may have a single pivot or multiple pivots, and in the latter case the user support pivots about a theoretical pivot axis of the combined pivotal movement. In the above embodiments, the user support pivot axis is at a horizontal level which is spaced below the user engaging surface of at least one of the user support portions of the user support frame in at least one of the exercise start and end positions. The pivot mount or pivot assembly is lower than the hips of the user through at least part of the exercise movement in each of the above embodiments. Any of the various embodiments could have the resistance associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

Although the exercise machines described above are single, stand-alone exercise machines, any of them may be incorporated as one of the exercise stations in a multi-station exercise machine. As is the case with the upper back exercise machine of FIGS. 17 to 21, the exercise machines may also be multi-use exercise machines on which different exercises may be performed. In each case, the multiple user support pads provide secure and safe positioning, placing the user in the proper exercise alignment from start to finish, without any adjustment required by the user. The seat and upper body support (chest pad or back pad) travel together in fixed alignment to keep the user in the same position throughout the exercise motion so that the user does not have to worry about balancing on a moving platform or pad.

In each case, the user support is positioned relatively low to the ground in the start and end position, making the machines quicker, easier, and safer to enter and exit. The user does not have to climb up or down in order to get into, or out of, the exercise position. The low profile also makes the machines more economical to produce and less intimidating to the user. The combined exercise arm and user support movement produces an automatic and continuous self-aligning exercise motion that allows enhanced hand, wrist and foot positioning versus free weight and free bar exercises or prior art machines for performing equivalents of such exercises.

Other exercise machines with rocking seats may incorporate a multiple part connecting linkage as described above, such as a seated dip exercise machine, a leg press exercise machine, or other exercise machines, as described in co-pending application Ser. No. 10/633,805 referenced above, the entire contents of which are incorporated herein by reference.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a stationary main frame;

a user support frame;

a pivot mount which pivotally supports the user support frame relative to the main frame for rotation along a predetermined path about a user support pivot axis from an exercise start position during an exercise, the pivot mount defining the location of the user support pivot axis whereby a gravitational center line which extends vertically through the user support pivot axis also extends through the user support frame during the rotation of the user support frame along said predetermined path;

the user support frame having at least a primary support portion and a secondary support portion which are adapted to engage different parts of a user's body throughout an exercise movement, the secondary support portion being secured at a fixed angular orientation relative to the primary support portion as the user support frame moves along the predetermined path during an exercise, the primary support portion supporting the majority of a user's weight in the start position of the support frame;

a user engagement device movably mounted relative to the frames which is engaged by the user in performing exercises;

a multiple part connecting linkage separate from the user engagement device and the pivot mount which translates movement of the user engagement device to movement of the user support frame, at least one part of the connecting linkage engaging the stationary main frame;

a load for resisting movement of at least one of the user support, user engagement device, and connecting linkage; and the user support pivot axis lying on a horizontal line which is spaced below at least one of the support portions in at least one of the exercise start and end positions.

2. The machine of claim 1, wherein the multiple part connecting linkage comprises at least a first part and a second part.

3. The machine of claim 2, wherein the first and second parts of the connecting linkage are adjustably engaged.

4. The machine of claim 2, wherein the first part is pivotally associated with the second part.

5. The machine of claim 2, wherein the first part is pivotally associated with the user engagement device.

6. The machine of claim 5, wherein the second part is pivotally associated with the user support frame.

7. The machine of claim 5, wherein the second part is associated with the main frame.

8. The machine of claim 7, wherein the second part is movably associated with the user support frame.

9. The machine of claim 5, wherein the second part is slidably engaged with one of the frames.

10. The machine of claim 2, wherein the first part comprises a flexible elongate member, whereby at least a portion of the connecting linkage is bendable.

11. The machine of claim 10, wherein the second part comprises at least one rotatable member rotatably mounted on one of the main frame, user support frame, and user engagement device, the rotatable member being engaged by the flexible elongate member.

12. The machine of claim 11, wherein the multi-part connecting linkage further comprises a third part, the third part comprising a second flexible elongate member which engages the rotatable member, the first flexible elongate member being associated with the user engagement device and the second flexible elongate member being associated with the user support frame.

13. The machine of claim 11, wherein the rotatable member comprises a pulley.

14. The machine of claim 10, wherein the user engagement device comprises at least one user engaging handle and an elongate member which is flexible along at least part of its length extending from the handle and associated with the connecting linkage.

15. The machine of claim 10, wherein the user engagement device comprises at least one exercise arm and the flexible elongate member extends from the exercise arm, and the second part of the connecting linkage comprises a pivotal connection to the user support frame which defines a swivel axis.

16. The machine of claim 15, wherein the second part of the connecting linkage further comprises a swiveling pulley rotatable about a pulley axis and associated with the pivotal connection for swiveling movement relative to the user support frame about the swivel axis.

17. The machine of claim 16, wherein the user support frame has a forward end, a rear end, and opposite first and second sides which are on opposite sides of a user when positioned in an exercise ready position on the user support frame, and the user engagement device comprises a first exercise arm located on the first side of the user support frame and a second exercise arm located on the second side of the user support frame, and the flexible elongate member extends in a path extending from the first exercise arm to the swiveling pulley and from the swiveling pulley up to the second exercise arm.

18. The machine of claim 17, wherein the connecting linkage further comprises a first guide pulley on the main frame which engages the flexible elongate member in the path from the first exercise arm to the pivotal connection and a second guide pulley on the main frame which engages the flexible elongate member in the path from the pivotal connection to the second exercise arm.

19. The machine of claim 15, wherein the connecting linkage further comprises at least one guide pulley on the main frame in a path from the exercise arm to the pivotal connection, and the flexible elongate member engages the guide pulley between the exercise arm and pivotal connection.

20. The machine of claim 15, wherein the exercise arm is an articulating arm.

21. The machine of claim 1, wherein the connecting linkage comprises multiple rigid links.

22. The machine of claim 1, wherein the user engagement device comprises at least one elongate exercise arm which is flexible along at least part of its length.

23. The machine of claim 1, wherein the user engagement device comprises at least one articulated exercise arm.

24. The machine of claim 1, wherein the user engagement device comprises first and second exercise arms located on opposite sides of the user support frame.

25. The machine of claim 1, wherein the user engagement device comprises at least one rigid exercise arm.

26. An exercise machine, comprising:

a stationary main frame;

a user support frame which supports a user in an exercise position;

a pivot assembly pivotally mounting the user support frame relative to the main frame for rotation about a user support pivot axis along a predetermined arcuate path during an exercise;

the pivot assembly being lower than the hips of a user supported in an exercise position on the user support frame through at least part of an exercise movement;

the user support frame having at least a primary support and a secondary support which support spaced positions on a user's body throughout an exercise movement, the secondary support being secured at a fixed angular orientation relative to the primary support and not moving relative to the primary support as the user support frame rotates along said arcuate path during an exercise, the primary support supporting the majority of a user's weight in the start position of the support frame;

a user engagement device movably mounted relative to the frames for engagement by the user in performing exercises;

a multiple part connecting linkage which is not part of the user support pivot assembly and which translates movement of the user engagement device to movement of the user support frame;

all movement of each part of the connecting linkage during an exercise comprising at least partially non-linear movement; and a load for resisting movement of at least one of the user support, user engagement device, and connecting linkage.

27. The machine of claim 26, wherein the user engagement device is movably associated with the main frame.

28. The machine of claim 26, wherein the user support pivot axis is positioned such that a gravitational center line extending vertically through the user support pivot axis extends through the user support frame as the user support frame rotates about said pivot axis along at least part of said arcuate path.

29. The machine of claim 28, wherein the gravitational center line extends through the user support frame in all positions of the user support frame along said arcuate path during an exercise.

30. The machine of claim 26, wherein the pivot assembly comprises a multiple pivot linkage having a plurality of pivots which together define said user support pivot axis.

31. The machine of claim 30, wherein the multiple pivot linkage comprises a four bar pivot system.

32. The machine of claim 26, wherein the pivot assembly comprises a pivot mount on the main frame and a pivot connection between the pivot mount and user support frame which defines the user support pivot axis.

33. The machine of claim 26, wherein the multiple part connecting linkage comprises at least two adjustably engaged parts.

34. The machine of claim 26, wherein the multiple part connecting linkage comprises at least two pivotally engaged links.

35. The machine of claim 26, wherein the connecting linkage is pivotally associated with at least one of the user support frame and user engagement device.

36. The machine of claim 35, wherein the connecting linkage is pivotally associated with both the user support frame and the user engagement device.

37. The machine of claim 35, wherein the connecting linkage includes a part which is slidably associated with at least one of the frames.

38. An exercise machine, comprising:

a stationary main frame;

a user support frame which is adapted to support a user in an exercise ready position, the user support frame being pivotally mounted for rotation relative to the main frame about a user support pivot axis along a predetermined arcuate path from an exercise start position during an exercise;

the user support frame having at least a primary support portion adapted to engage a first part of a user's body and a secondary support portion spaced from the primary support portion and adapted to engage a second part of a user's body when the user is supported in the exercise ready position, the secondary support portion being secured at a fixed angular orientation relative to the primary support portion and not moving relative to the primary support portion throughout an exercise as the user support frame pivots about said user support pivot axis along the predetermined arcuate path, the primary support portion supporting the majority of a user's weight in the start position of the support frame;

the user support pivot axis being at a horizontal level spaced below a user engaging surface of at least one of the support portions during at least part of the pivotal movement of said user support frame along the predetermined arcuate path;

a user engagement device movably associated with at least one of the frames and engaged by the user in performing exercises;

a multiple part connecting linkage which translates movement of the user engagement device to rotational movement of the user support frame;

all movement of the connecting linkage during an exercise comprising rotational movement; and a load for resisting movement of at least one of the user support, user engagement device, and connecting linkage.

39. The machine as claimed in claim 38, wherein the user engagement device comprises at least one rigid exercise arm.

40. The machine as claimed in claim 38, wherein the user support frame supports a user in a seated position and the user engagement device has at least one handle for gripping and moving by a user to perform an upper back exercise.

41. The machine of claim 38, further comprising a multiple part pivot assembly which pivotally mounts the user support frame for rotational movement relative to the main frame about said user support pivot axis, the multiple parts of the pivot assembly together defining the location of the user support pivot axis.

42. The machine of claim 41, wherein the multiple part pivot assembly comprises a four bar pivot system.

43. The machine of claim 38, wherein the user support pivot axis is positioned such that a gravitational center line which extends vertically through the user support pivot axis extends through the user support frame through at least part of the pivotal movement of the user support frame along the predetermined arcuate path during an exercise.

44. The machine of claim 38, wherein the multiple part connecting linkage comprises at least first and second parts.

45. The machine of claim 44, wherein the first part is associated with the user engagement device.

46. The machine of claim 45, wherein the second part is pivotally connected to the user support frame.

47. The machine of claim 44, wherein the first and second parts are adjustably engaged.

48. The machine of claim 38, wherein the multiple part connecting linkage comprises more than two parts.

49. The machine of claim 38, wherein the multiple part connecting linkage comprises multiple rigid parts.

50. The machine of claim 23, wherein the articulated exercise arm has first and second elongate portions, the first elongate portion is pivotally connected to one of the frames for rotation about a first pivot axis and the second elongate portion is pivotally connected to the second elongate portion for rotation about a second pivot axis spaced from the first pivot axis, and a user engaging portion is associated with the second elongate portion and adapted for engagement by a user in performing an exercise, whereby movement of the first and second elongate portions about said first and second pivot axes results in movement of the user engaging portion along an elliptical travel path.

51. The machine of claim 22, wherein the elongate exercise arm is of flexible material.

52. The machine of claim 51, wherein the exercise arm comprises a cable.

53. The machine of claim 14, wherein the user engagement device comprises an elongate member of flexible material.

54. The machine of claim 12, wherein the rotatable member comprises a dual cam assembly having first and second cams rotatably mounted on a single pivot axis, the first flexible elongate member engaging the first cam and the second flexible elongate member engaging the second cam.

* * * * *